US005623237A

United States Patent [19]

Okamura

[11] Patent Number: 5,623,237

[45] Date of Patent: Apr. 22, 1997

[54] RESONATOR AND FILTER WITH A SPACED AWAY GROUND ELECTRODE CONNECTION STRIPLINE

[75] Inventor: Hisatake Okamura, Nagaokakyo, Japan

[73] Assignee: Murata Manufacturing Co., Ltd., Japan

[21] Appl. No.: 419,809

[22] Filed: Apr. 11, 1995

[30] Foreign Application Priority Data

Apr. 13, 1994 [JP] Japan ..... 6-100571

[51] Int. Cl.[6] ..... H01P 1/203; H01P 7/08

[52] U.S. Cl. ..... 333/204; 333/219

[58] Field of Search ..... 333/185, 202, 333/204, 219

[56] References Cited

U.S. PATENT DOCUMENTS 5,404,118 4/1995 Okamura et al. ..... 333/219 X

FOREIGN PATENT DOCUMENTS 5308202 11/1993 Japan ..... 333/204
6053704 2/1994 Japan ..... 333/202
6053716 2/1994 Japan ..... 333/219

*Primary Examiner*—Benny Lee
*Assistant Examiner*—Justin P. Bettendorf
*Attorney, Agent, or Firm*—Ostrolenk, Faber, Gerb & Soffen, LLP

[57] ABSTRACT

A resonator having a small size and/or a high Q value, for use in forming a filter with low insertion loss in spite of its small size. According to one aspect of the invention, a resonator includes a laminated body 22. The laminated body 22 includes a first dielectric layer 24*a*. On one surface of the first dielectric layer 24*a*, a loop shaped line electrode 26 and a strip shaped take-out electrode 28 are formed. On the other surface of the first dielectric layer 24*a*, a first earth electrode 30*a* and a first protection layer 34*a* are formed. On one surface of the first dielectric layer 24*a*, a second dielectric layer 24*b* is formed so as to cover the line electrode 26. On the second dielectric layer 24*b*, a second earth electrode 30*b* and a second protection layer 34*b* are formed. On side faces of the laminated body 22, six external electrodes are formed. One external electrode used as an earth terminal is connected to one end of the line electrode 26 and a lead-out electrode 32*a* of the first earth electrode 30*a*. Another three external electrodes used as the connecting electrodes having impedance are connected to the lead-out electrodes 32*a* of the first earth electrode 30*a* and the lead-out electrodes 32*b* of the second earth electrode 30*b*. Still another external electrode used as an input/output terminal is connected to the take-out electrode 28 of the line electrode 26.

16 Claims, 23 Drawing Sheets

RESONATOR AND FILTER WITH A SPACED AWAY GROUND ELECTRODE CONNECTION STRIPLINE

BACKGROUND OF THE INVENTION

1. Field of the Invention

The present invention relates to a resonator and filter, especially to the resonator and filter that can be used in a portable radiophone.

2. Description of the Prior Art

FIG. 33 is a perspective view showing a conventional resonator, and FIG. 34 is a sectional view taken on line XXXIV—XXXIV in FIG. 33, and FIG. 35 is an exploded perspective view showing a laminated body used for the resonator. A resonator 1 includes a laminated body 2 having a rectangular prism shape. The laminated body 2 includes a first dielectric layer 3*a* having a rectangular shape. A line electrode 4 having a loop shape is formed on one surface of the first dielectric layer 3*a*. The line electrode 4 is formed from one edge to the center portion of the dielectric layer 3*a*. The line electrode 4 acts as an inductor. A take-out electrode 5 is formed from the intermediate portion of the line electrode 4 to another edge of the first dielectric layer 3*a*, on one surface of the first dielectric layer 3*a*. A first earth electrode 6*a* is formed on the other surface of the first dielectric layer 3*a*. The first earth electrode 6*a* has four lead-out electrodes 7*a* which extend to two opposite ends of the other surface of the first dielectric layer 3*a*. On the other surface of the first earth electrode 6*a*, the first protection layer 8*a* made of dielectric or insulating material is formed so as to cover the first earth electrode 6*a*. A second dielectric layer 3*b* is formed on one surface of the first dielectric layer 3*a* so as to cover the line electrode 4 and the like. A second earth electrode 6*b* is formed on the second dielectric layer 3*b*. The second earth electrode 6*b* has four lead-out electrodes 7*b* which extend to the two opposite ends of the second dielectric layer 3*b*. A second protection layer 8*b* made of dielectric or insulating material is formed on the second dielectric layer 3*b* so as to cover the second earth electrode 6*b*.

Six external electrodes 9*a*–9*f* are formed on the side faces of the laminated body 2. The external electrode 9*a* is connected to one end of the line electrode 4 and to the lead-out electrodes 7*a* and 7*b* of the first and the second earth electrodes 6*a* and 6*b*. The external electrode 9*a* is used as an earth terminal. The external electrodes 9*b*, 9*d* and 9*e* are connected to the lead-out electrodes 7*a* and 7*b* of the first and the second earth electrodes 6*a* and 6*b* respectively. The external electrode 9*f* is connected to the take-out electrode 5 of the line electrode 4. The external electrode 9*f* is used as an input/output terminal.

FIG. 36 is a perspective view showing a conventional filter, and FIG. 37 is a sectional view of taken on line XXXVII—XXXVII in FIG. 36, and FIG. 38 is an exploded perspective view showing a laminated body used for the filter. A filter 11 includes a laminated body 12 having a rectangular prism shape. The laminated body 12 includes a first dielectric layer 13*a* having a rectangular shape. First and second line electrodes 14*a* and 14*b* having a loop shape are formed separately on one surface of the first dielectric layer 13*a*. The first and the second line electrodes 14*a* and 14*b* are formed symmetrically from opposite ends of the dielectric layer 13*a* to the center portion, on one main surface of the dielectric layer 13*a*. The first and the second line electrodes 14*a* and 14*b* are coupled electromagnetically.

The first and the second line electrodes 14*a* and 14*b* act as inductors of resonators. First and second take-out electrodes 15*a* and 15*b* are formed respectively from the intermediate portions of the first and the second electrodes 14*a* and 14*b* to the two ends of the first dielectric layer 13*a*, on one surface of the first dielectric layer 13*a*. A first earth electrode 16*a* is formed on the other surface of the first dielectric layer 13*a*. The first earth electrode 16*a* has six lead-out electrodes 17*a* which extend to the edges of the other surface of the first dielectric layer 13*a*. On the other surface of the first earth electrode 16*a*, a first protection layer 18*a* made of dielectric or insulating material is formed so as to cover the first earth electrode 16*a*. A second dielectric layer 13*b* is formed on one surface of the first dielectric layer 13*a* so as to cover the first and second line electrodes 14*a* and 14*b*. A second earth electrode 16*b* is formed on the second dielectric layer 13*b*. The second earth electrode 16*b* has six lead-out electrodes 17*b* which extend to the edges of the second dielectric layer 13*b*. A second protection layer 18*b* made of dielectric or insulating material is formed on the second dielectric layer 13*b* so as to cover the second earth electrode 16*b*.

Eight external electrodes 19*a*–19*h* are formed on the side faces of the laminated body 12. The external electrode 19*a* is connected to one end of the first line electrode 14*a*, and to the lead-out electrodes 17*a* and 17*b* of the first and the second earth electrodes 16*a* and 16*b*. The external electrode 19*c* is connected to one end of the second line electrode 14*b*, and to the lead-out electrodes 17*a* and 17*b* of the first and the second earth electrodes 16*a* and 16*b*. The external electrodes 19*a* and 19*c* are used as earth terminals. The external electrodes 19*b*, 19*e*, 19*f* and 19*g* are connected to the lead-out electrodes 17*a* and 17*b* of the first and the second earth electrodes 16*a* and 16*b* respectively. The external electrode 19*h* is connected to the first take-out electrode 15*a* of the first line electrode 14*a*. The external electrode 19*d* is connected to the second take-out electrode 15*b* of the second line electrode 14*b*. The external electrodes 19*h* and 19*d* are used as input/output terminals.

In the resonator 1 shown in FIG. 33, the distance between the line electrode 4 and the first earth electrode 6*a* and the distance between the line electrode 4 and the second earth electrode 6*b* are required to be wide, for example, more than 600 μm respectively, for obtaining a high Q value of about 60. This results in a large device size and a thick configuration.

In the resonator 1 shown in FIG. 33, the length of the line electrode 4 is required to be increased in order to increase the inductance component of the line electrode 4, in order to lower the resonance frequency. This also results in a large device size.

In the filter 11 shown in FIG. 36, the distance between the first and the second line electrodes 14*a*, 14*b* and the first earth electrode 16*a* and the distance between the first and the second line electrodes 14*a*, 14*b* and the second earth electrode 16*b* are required to be wide respectively, for obtaining a lower insertion loss with and a high Q value of each resonator. This results in a large device size and a thick configuration.

In the filter 11 shown in FIG. 36, the length of the first and the second line electrodes 14*a* and 14*b* are required to be increased in order to obtain a large inductance component of the first and the second line electrode 14*a* and 14*b*, in order to lower the resonance frequency of each resonator. This also results in a large device size.

SUMMARY OF THE INVENTION

Therefore, the main purpose of the present invention is to provide a resonator having small size and high Q value, and a filter having low insertion loss in spite of small size.

The present invention relates to a resonator comprising a first dielectric layer, a line electrode formed on one surface of the first dielectric layer, a first earth electrode located at the other surface of the dielectric layer, a second dielectric layer located such that the line electrode is between the first dielectric layer and the second dielectric layer, a second earth electrode located such that the second dielectric layer is between the line electrode and the second earth electrode, an input/output terminal connected to an intermediate portion of the line electrode, an earth terminal connected to one end of the line electrode and the first earth electrode, and a connecting electrode having impedance that is connected to the first earth electrode and the second earth electrode, said connecting electrode not being directly connected to the connection between the line electrode and the first earth electrode.

In the resonator of the present invention, the line electrode is preferably formed from the edge to the center portion on one surface of the dielectric layer for reasons to be described later.

In the resonator of the present invention, the second dielectric layer is preferably formed to be thinner than the first dielectric layer for reasons to be described later.

The present invention also relates to another resonator comprising a first dielectric layer, a line electrode formed on one surface of the first dielectric layer, a first earth electrode disposed adjacent to the other surface of the first dielectric layer, a second dielectric layer disposed with the line electrode between the first dielectric layer and the second dielectric layer, a second earth electrode disposed the second dielectric layer between the line electrode and the second earth electrode, an input/output terminal connected to an intermediate portion of the line electrode, an earth terminal connected to the first earth electrode, and a connecting electrode having impedance that is connected to the first earth electrode and the second earth electrode but not directly connected to the connection between the first earth electrode and the earth terminal.

In this other resonator of the present invention, the line electrode is preferably formed on the center portion of one surface of the first dielectric layer for reasons to be described later.

In this other resonator of the present invention, the second dielectric layer is preferably formed to be thinner than the first dielectric layer for reasons to be described later.

The present invention further relates to a filter comprising a first dielectric layer, plural line electrodes formed separately on one surface of the first dielectric layer and coupled electromagnetically with each other, a first earth electrode adjacent the other surface of the first dielectric layer, a second dielectric layer adjacent the plural line electrodes which are thereby between the first dielectric layer and the second dielectric layer, a second earth electrode adjacent the second dielectric layer which is thereby between the plural line electrodes and the second dielectric layer, two input/output terminals connected respectively to intermediate portions of two of the plural line electrodes, earth terminals connected to first ends of the plural line electrodes and the first earth electrode, and a connecting electrode having impedance that is connected to the first earth electrode and the second earth electrode but not directly connected to the first ends portions of the plural line electrodes.

In the filter of the present invention, the plural line electrodes are preferably formed from the edge to the center portion on one surface of the first dielectric layer for reasons to be described later.

In the filter of the present invention, the second dielectric layer is preferably formed to be thinner than the first dielectric layer for reasons to be described later.

The present invention also relates to another filter comprising a first dielectric layer, plural line electrodes formed separately on one surface of the first dielectric layer and coupled electromagnetically with each other, a first earth electrode adjacent the other surface of the first dielectric layer, a second dielectric layer adjacent the plural line which are thereby between the first dielectric layer and the second dielectric layer, a second earth electrode adjacent the second dielectric layer which is thereby between the plural line electrodes and the second earth electrode, two input/output terminals connected respectively to intermediate portions of two of the plural line electrodes, earth terminals connected to the first earth electrode, and a connecting electrode having impedance that is connected to the first earth electrode and the second earth electrode but not directly connected to the connection between the first earth electrode and the earth terminals.

In this other filter of the present invention, the plural line electrodes are preferably formed on center portions of one surface of the first dielectric layer for reasons to be described later.

In this other filter of the present invention, the second dielectric layer is preferably formed to be thinner than the first dielectric layer for reasons to be described later.

The first-mentioned resonator of the present invention is a $\lambda/4$ resonator, since the earth terminal is connected to one end of the line electrode and the first earth electrode.

The other resonator of the present invention is a $\lambda/2$ resonator, since the earth terminal is not connected to the line electrode.

In the resonators of the present invention described above, the earth terminal is connected to the second earth electrode via impedance of the connecting electrode. Thus, the second earth electrode does not affect the Q value any more, and the reduction of Q value is prevented even the distance between the line electrode and the second earth electrode is reduced, namely by making the second dielectric layer thinner. By reducing the thickness of the second dielectric layer, the resonator can be minimized, and stray capacitance between the line electrode and the second earth electrode can be increased, resulting in lowered resonance frequency.

In the filter of the first-mentioned present invention, the plural resonators made with plural line electrodes are $\lambda/4$ resonators, since the earth terminals are connected respectively to the first ends of the plural line electrodes and the first earth electrode.

In the other filter of the present invention, the plural resonators made with plural line electrodes are $\lambda/2$ resonators, since the earth terminals are not connected to the plural line electrodes.

In the filters of the present invention described above, the earth terminals are connected to the second earth electrode via impedance of the connecting electrodes. Thus, the second earth electrode does not affect the Q value any more, and the reduction of Q value is prevented even though distance between the plural line electrodes and the second earth electrode is reduced, by making the second dielectric layer thinner. By reducing the thickness of the second dielectric layer, the filter can be minimized, and stray capacitance between the plural line electrodes and the second earth electrode is increased, resulting in lowered resonance frequency.

According to the present invention, the resonator having high Q value and small size is obtained.

According to the present invention, the filter having low insertion loss and small size is obtained.

In the resonator of the present invention, the earth terminal is connected to one end of the line electrode by forming an earth terminal on the side of the first dielectric layer in the case where the line electrode is formed from the edge to the center portion on one surface of the first dielectric layer.

In the resonator of the present invention, when the second dielectric layer is made thinner, the device is miniaturized, and stray capacitance between the line electrode and the second earth electrode is increased, resulting in lowered resonance frequency. Alternatively, a much higher Q value can be obtained by increasing the thickness of the first dielectric layer by the amount of reduced thickness of the second dielectric layer.

In the other resonator of the present invention, the earth terminal is not connected to the line electrode because the line electrode is formed in the center portion of one surface of the first dielectric layer and does not extend to the earth terminal on the side of the first dielectric layer.

In the other resonator of the present invention, when the second dielectric layer is made thinner, the device is miniaturized, and stray capacitance between the line electrode and the second earth electrode is increased, resulting in lowered resonance frequency. Alternatively, a much higher Q value can be obtained by increasing the thickness of the first dielectric layer by the amount of reduced thickness of the second dielectric layer.

In the filter of the present invention, the earth terminals are connected respectively to first ends of the plural line electrodes by forming earth terminals on the side the first dielectric layer and of forming the plural line electrodes from the edge to the center portion on one surface of the first dielectric layer.

In the filter of the present invention, when the second dielectric layer is made thinner, the device is miniaturized, and stray capacitance between plural line electrodes and the second earth electrode is increased, resulting in lowered resonance frequency of plural resonators. Or, a much higher Q value can be obtained by increasing thickness of the first dielectric layer by the amount of reduced thickness of the second dielectric layer.

In the other filter of the present invention, the earth terminals are not connected to the plural line electrodes because the line electrodes are formed in the center portion of one surface of the first dielectric layer and do not extend to the earth terminals on the side of the first dielectric layer.

In the other filter of the present invention, the second dielectric layer is made thinner, the device is miniaturized, and stray capacitance between plural line electrodes and the second earth electrode is increased, resulting in lowered resonance frequency of plural resonators. Or, a much higher Q value can be obtained by increasing thickness of the first dielectric layer by the amount of reduced thickness of the second dielectric layer.

The above and further objects, features, aspects and advantages of the invention will more fully be apparent from the following detailed description of embodiments with reference to the accompanying drawings.

DESCRIPTION OF THE PREFERRED EMBODIMENTS

Figure 1:
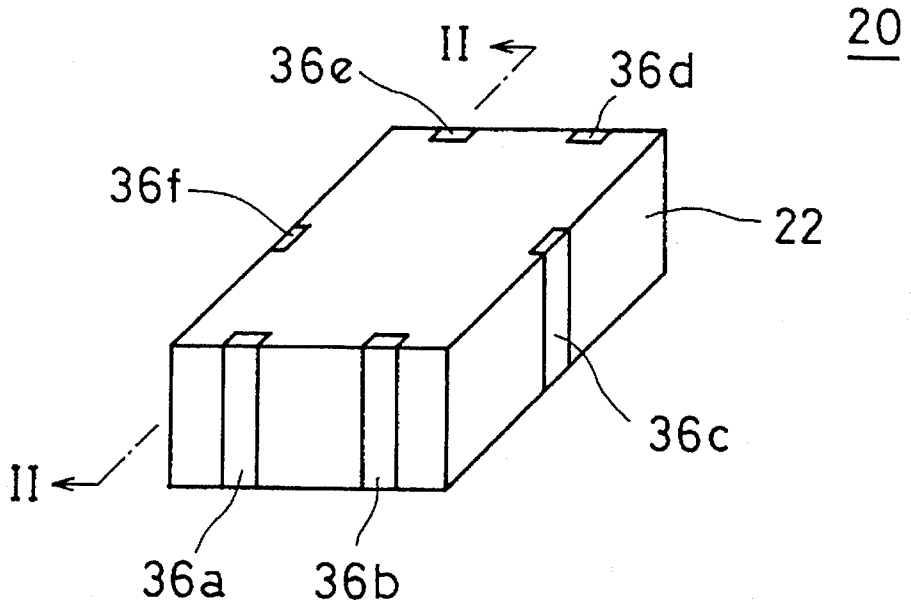
FIG. 1 is a perspective view showing a resonator as an example of the present invention.
Figure 2:
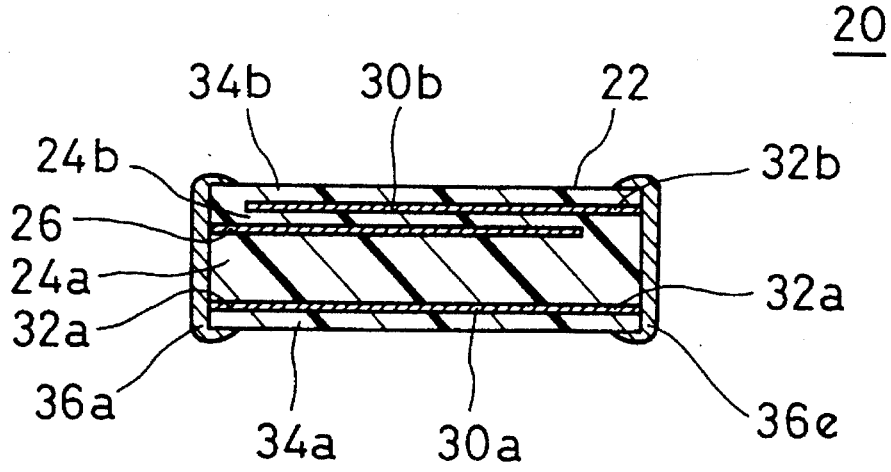
FIG. 2 is a sectional view of line II—II in FIG. 1.
Figure 3:
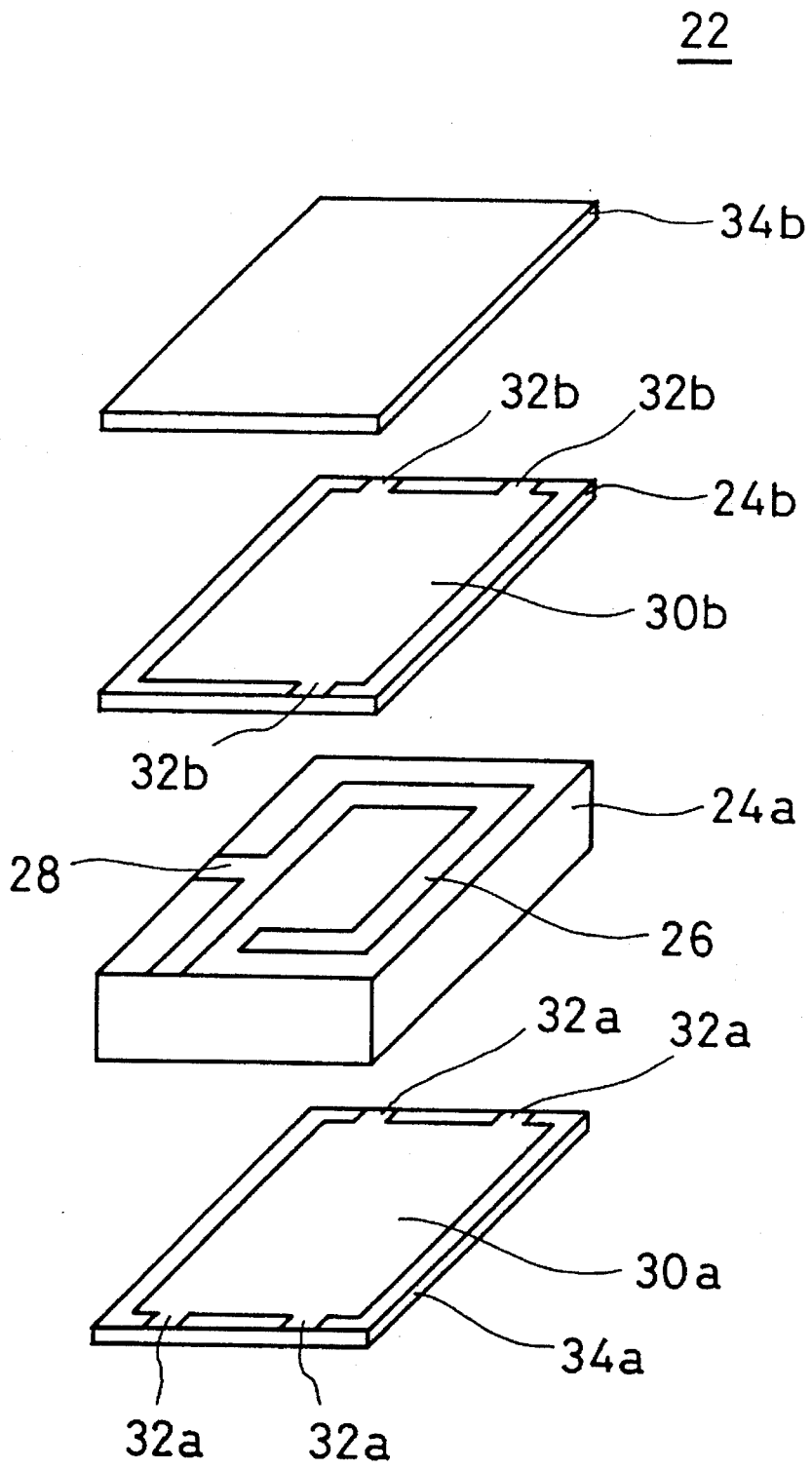
FIG. 3 is an exploded perspective view showing a laminated body used for the resonator shown in FIG. 1.

FIG. 1 is a perspective view showing a resonator as an embodiment of the present invention, FIG. 2 is a sectional view of taken on line II—II in FIG. 1, and FIG. 3 is an exploded perspective view showing a laminated body used for the resonator shown in FIG. 1. A resonator 20 includes a laminated body 22 having a rectangular prism shape. The laminated body 22 includes a first dielectric layer 24*a* having rectangular shape.

On one surface of the first dielectric layer 24*a*, a line electrode 26 having, for example, a loop shape is formed. The line electrode 26 is formed from one end to the center portion on one surface of the first dielectric layer 24*a*.

On one surface of the dielectric layer 24*a*, a take-out electrode 28 having, for example, a strip shape is formed from the intermediate portion of the line electrode 26 to the other edge of the first dielectric layer 24*a*.

Adjacent the other surface of the dielectric layer 24*a*, a first earth electrode 30*a* is formed. The first earth electrode 30*a* has four lead-out electrodes 32*a*. The lead-out electrodes 32*a* are formed so as to extend to the both ends on the other surface of the first dielectric layer 24*a*, including the portion corresponding to one end of the line electrode 26.

Adjacent the other surface of the first earth electrode 30*a*, a first protection layer 34*a* is formed with, for example, dielectric material to cover the first earth electrode 30*a*.

On one surface of the dielectric layer 24*a*, a second dielectric layer 24*b* is formed to cover the line electrode 26 and the like.

On the second dielectric layer 24*b*, a second earth electrode 30*b* is formed. The second earth electrode 30*b* has three lead-out electrodes 32*b*. The lead-out electrodes 32*b* are formed on the portions other than the portion corresponding to one end of the line electrode 26, so as to extend to both ends of the second dielectric layer 24*b* and corresponding to three of the lead-out electrodes of the first earth electrode 30*a*.

On the second dielectric layer 24*b*, a second protection layer 34*b* is formed with, for example, dielectric material to cover the second earth electrode 30*b*.

On side faces of the laminated body 22, six external electrodes 36*a*–36*f* are formed. The external electrode 36*a* is connected to one end of the line electrode 26 and the lead-out electrode 32*a* of the first earth electrode 30*a*. The external electrode 36*a* is used as an earth terminal. The external electrodes 36*b*, 36*d* and 36*e* are connected to the lead-out electrodes 32*a* and 32*b* of the first and the second earth electrodes 30*a* and 30*b*. The external electrodes 36*b*, 36*d* and 36*e* are used as the connecting electrodes having impedance. The external electrode 36*f* is connected to the take-out electrode 28 of the line electrode 26. The external electrode 36*f* is used as an input/output terminal.

Figure 4:
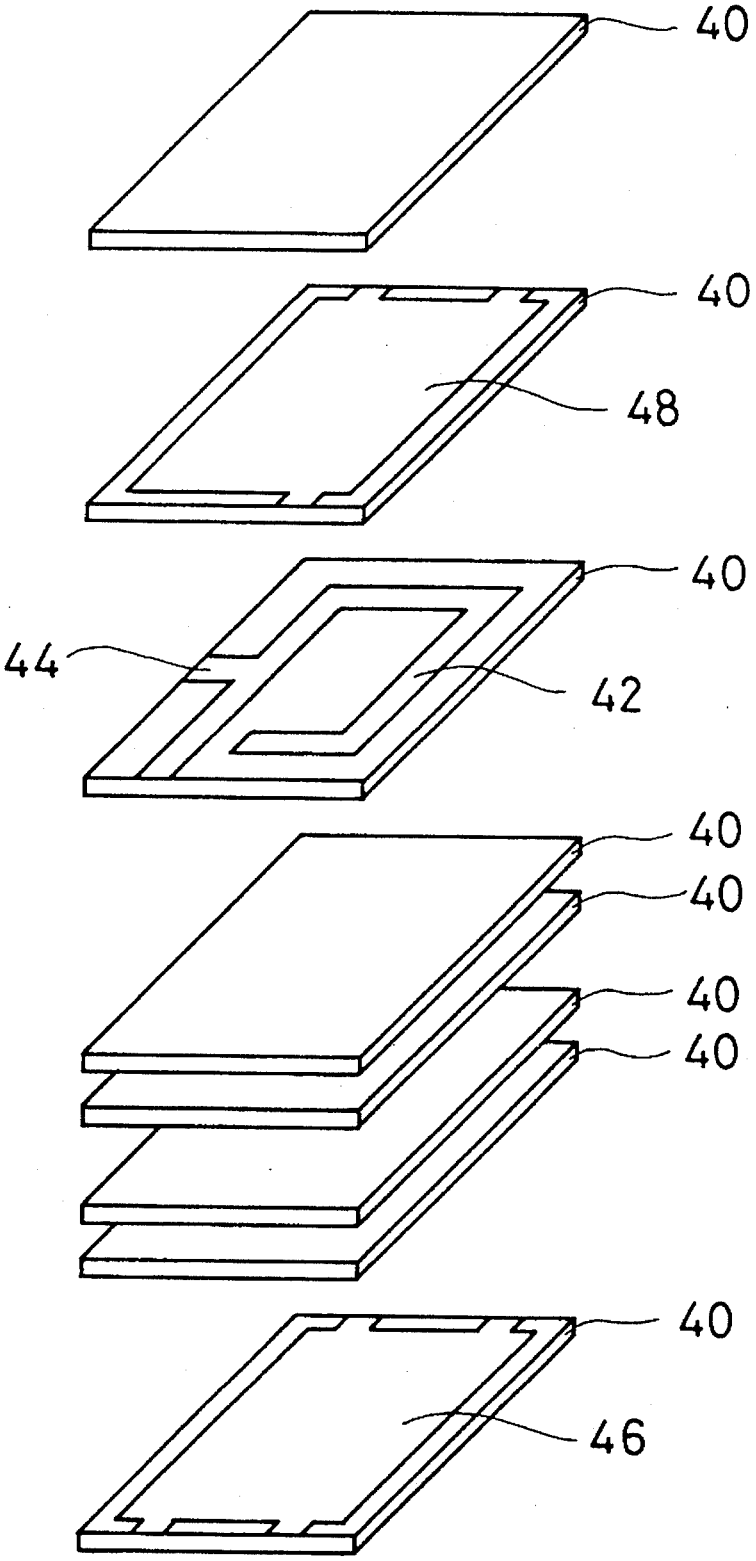
FIG. 4 is an exploded perspective view showing one process of manufacturing the resonator shown in FIG. 1.

As shown in FIG. 4, plural rectangular ceramic green sheets 40 formed with dielectric material are prepared to form the resonator 20.

On one sheet 40, a loop shaped line electrode pattern 42 and a strip shaped take-out electrode pattern 44 are formed with copper paste or the like.

On an another sheet 40, a first earth electrode pattern 46 is formed with copper paste or the like.

On a still another sheet 40, a second earth electrode pattern 48 is formed with copper paste or the like.

The other sheets 40 are inserted between the sheets having electrode patterns according to requirement. On the sheet 40 having the second earth electrode pattern 48, another sheet 40 is placed. A body is completed by laminating the sheets 40 and pressing it.

As shown in FIG. 1, external electrode patterns are formed on side faces of the body with copper paste or the like. The resonator 20 is obtained by firing the body. The external electrodes may be formed by sintering electrode material to the body after firing the body without external electrode patterns.

The resonator 20 is a $\lambda/4$ resonator, since the external electrode 36*a* used as the earth terminal is connected to one end of the line electrode 26 and the lead-out electrode 32*a* of the first earth electrode 30*a*.

In the resonator 20, the external electrode 36*a* used as the earth terminal is not connected directly to the second earth electrode 30*b*, but is connected to the lead-out electrodes 32*b* of the second earth electrode 30*b* via impedance of external electrodes 36*b*, 36*d* and 36*e*. The electric potential of the second earth electrode 30*b* with respect to the line electrode 26 is higher than that of the first earth electrode 30*a*, and this does not affect Q value. As a result, the Q value of the resonator is not lowered, even though the distance between the line electrode 26 and the second earth electrode 30*b* is reduced, namely the second dielectric layer 24*b* is made thinner.

In the resonator 20, since the line electrode 26 is formed from the edge to the center portion on one surface of the first dielectric layer 24*a*, the external electrode 36*a* is connected to one end of the line electrode 26 by forming it on the side of the first dielectric layer 24*a*.

In the resonator 20, when the second dielectric layer 24b is made thinner, the device can be miniaturized, and stray capacitance between the line electrode 26 and the second earth electrode 30b is increased, resulting in a lowered resonance frequency. Thus the device can be made smaller than a conventional device, while having similar characteristics. On the other hand, by increasing the thickness of the first dielectric layer 24a by the same amount as the thickness of the second dielectric layer 24b is decreased, a resonator having a higher Q value than a conventional device is obtained without making the device larger than the conventional device.

Figure 5:
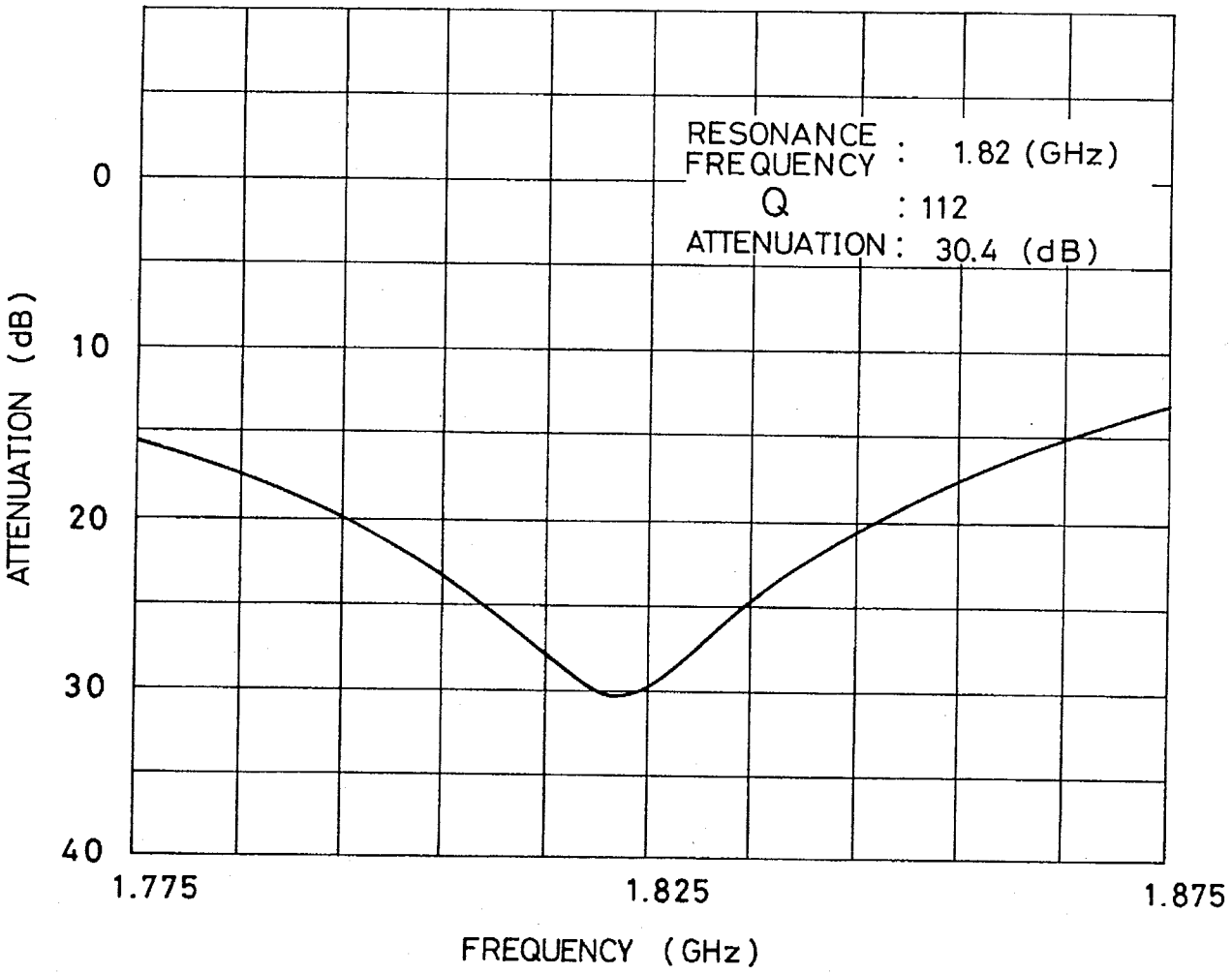
FIG. 5 is a graph showing frequency characteristics of the resonator shown in FIG. 1 with distance of 750 μm between line electrode and first earth electrode and with distance of 750 μm between line electrode and second earth electrode.
Figure 6:
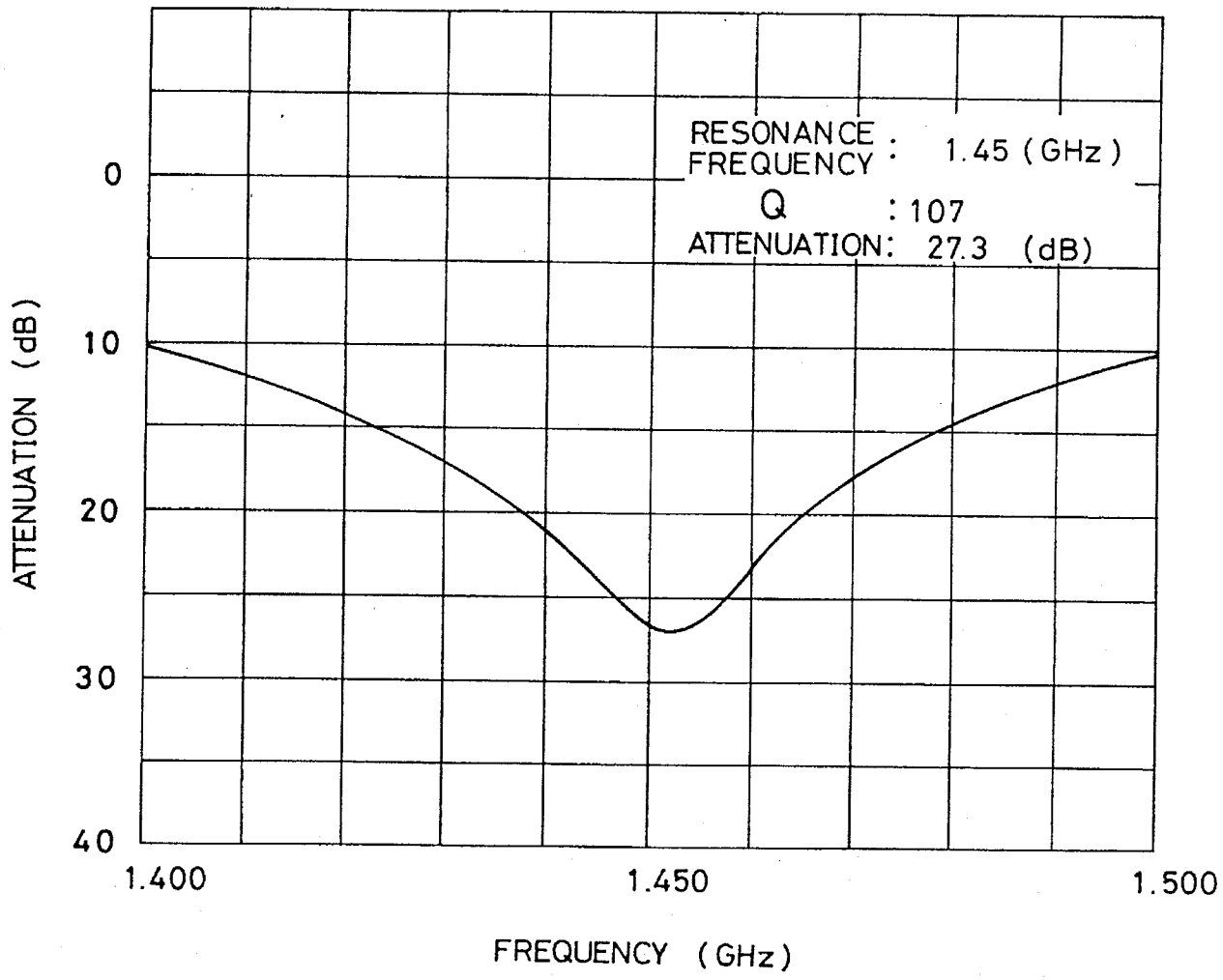
FIG. 6 is a graph showing frequency characteristics of the resonator shown in FIG. 1 with distance of 100 μm between line electrode and first earth electrode and with distance of 500 μm between line electrode and second earth electrode.
Figure 7:
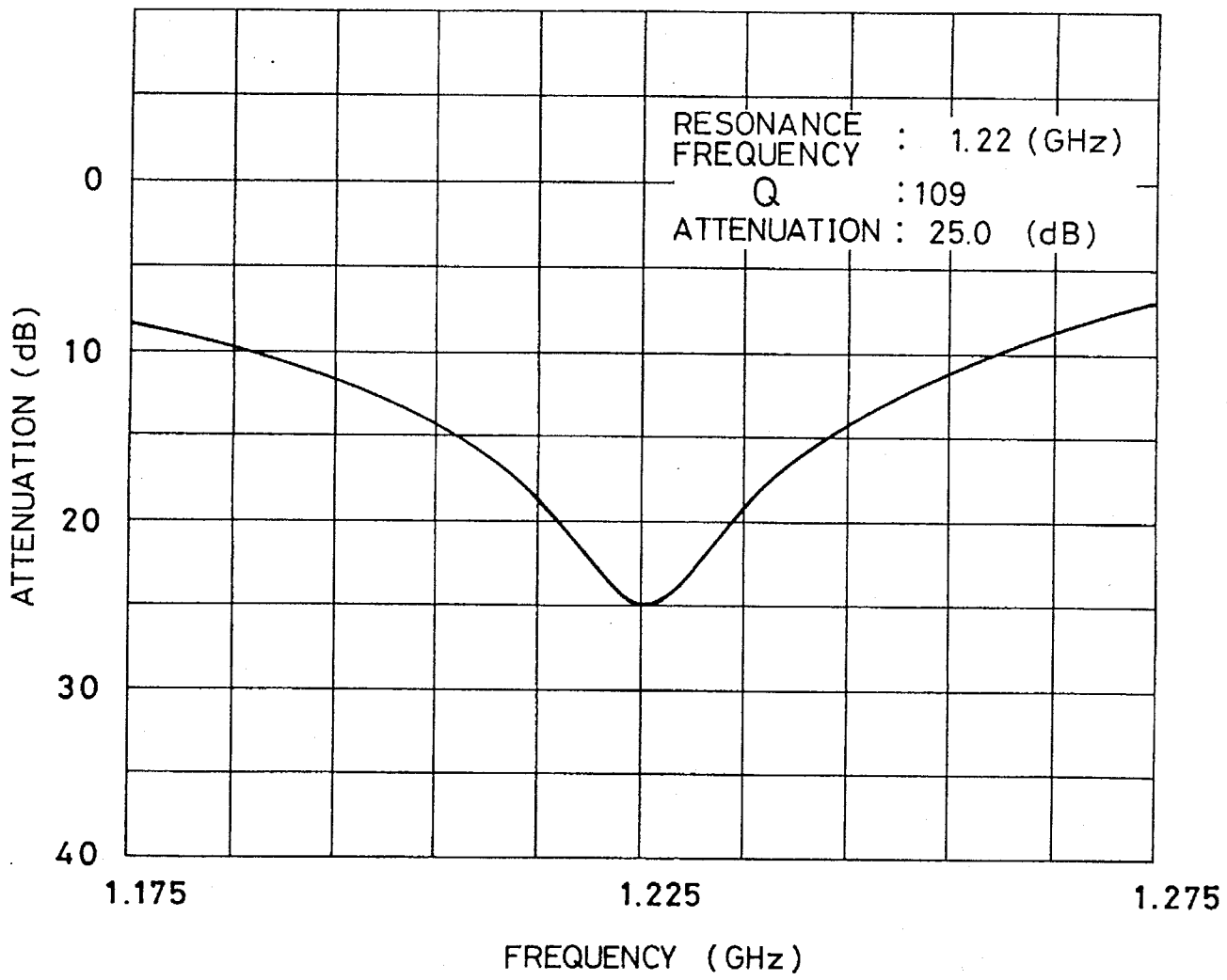
FIG. 7 is a graph showing frequency characteristics of the resonator shown in FIG. 1 with distance of 1200 μm between line electrode and first earth electrode and with distance of 300 μm between line electrode and second earth electrode.
Figure 8:
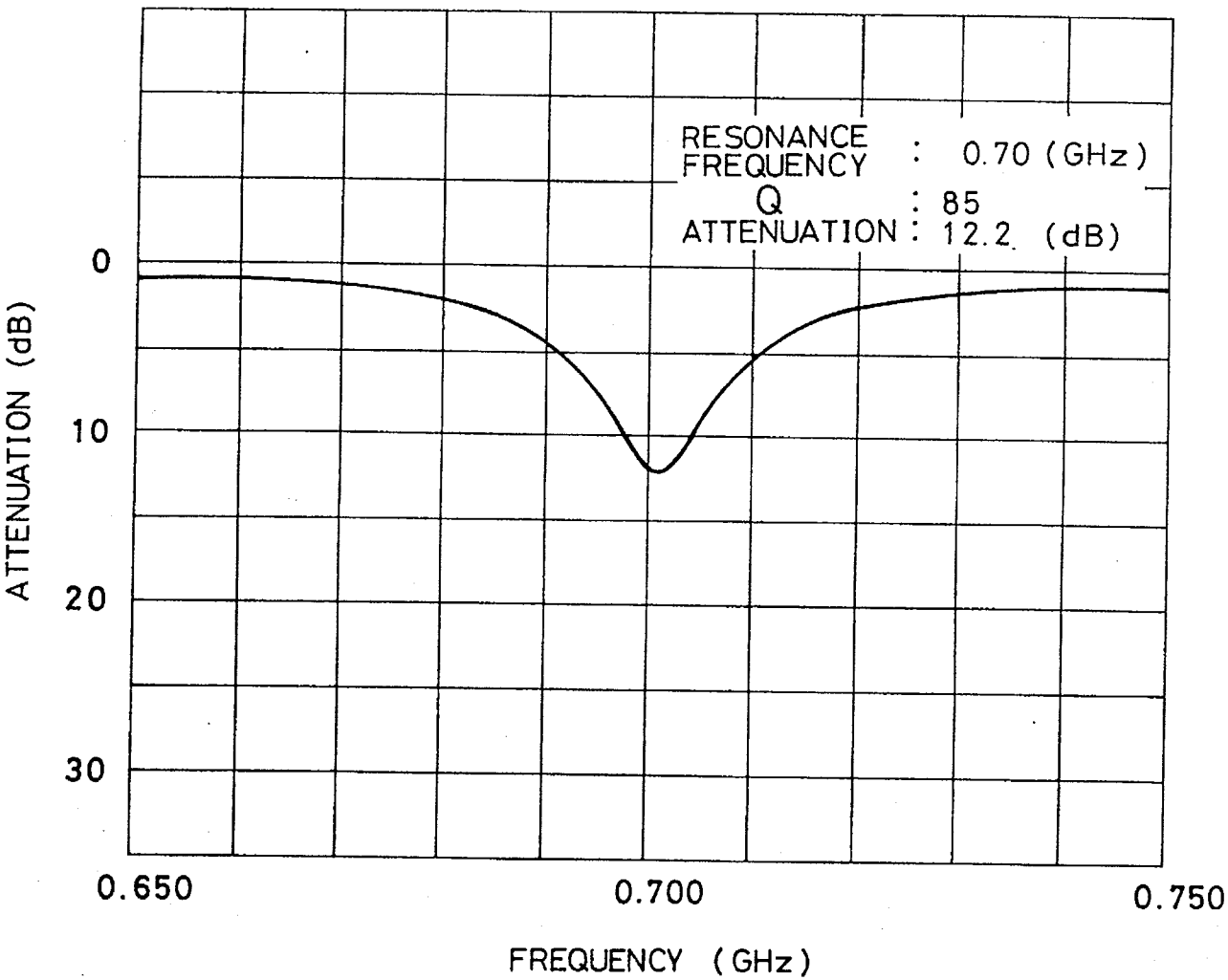
FIG. 8 is a graph showing frequency characteristics of the resonator shown in FIG. 1 with distance of 1400 μm between line electrode and first earth electrode and with distance of 100 μm between line electrode and second earth electrode.

The frequency characteristics are shown in FIG. 5 in the case of resonator 20 with a distance of 750 μm between the line electrode and the first earth electrode and a distance of 750 μm between the line electrode and the second earth electrode. The frequency characteristics are shown in FIG. 6 in the case of the resonator 20 with a distance of 1000 μm between the line electrode and the first earth electrode and a distance of 500 μm between the line electrode and the second earth electrode. The frequency characteristics are shown in FIG. 7 in the case of the resonator 20 with a distance of 1200 μm between the line electrode and the first earth electrode and a distance of 300 μm between the line electrode and the second earth electrode. The frequency characteristics are shown in FIG. 8 in the case of the resonator 20 with a distance of 1400 μm between the line electrode and the first earth electrode and a distance of 100 μm between the line electrode and the second earth electrode.

From the frequency characteristics shown in FIGS. 5–8, it is known that the resonance frequency of the resonator 20 is lowered by reducing the thickness of the second dielectric layer 24b.

Figure 33:
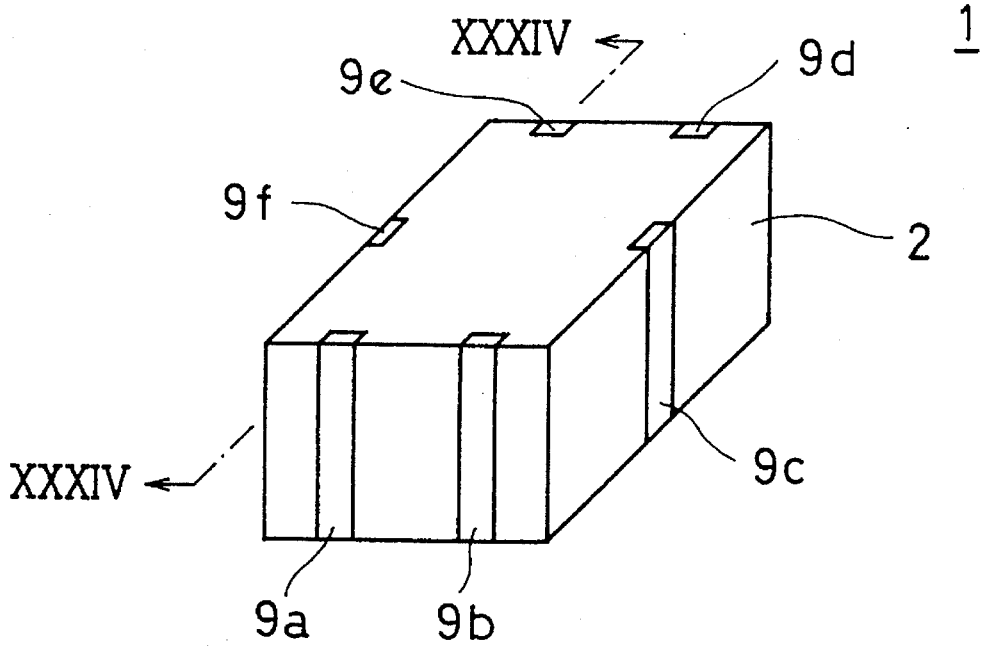
FIG. 33 PRIOR ART
FIG. 33 is a perspective view showing an example of a conventional resonator.
Figure 34:
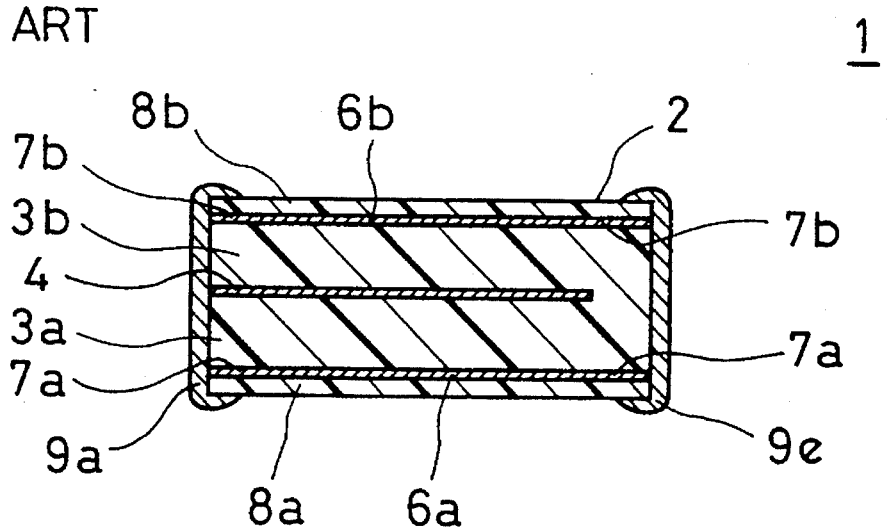
FIG. 34 PRIOR ART
FIG. 34 is a sectional view of line XXXIV—XXXIV in FIG. 33.
Figure 35:
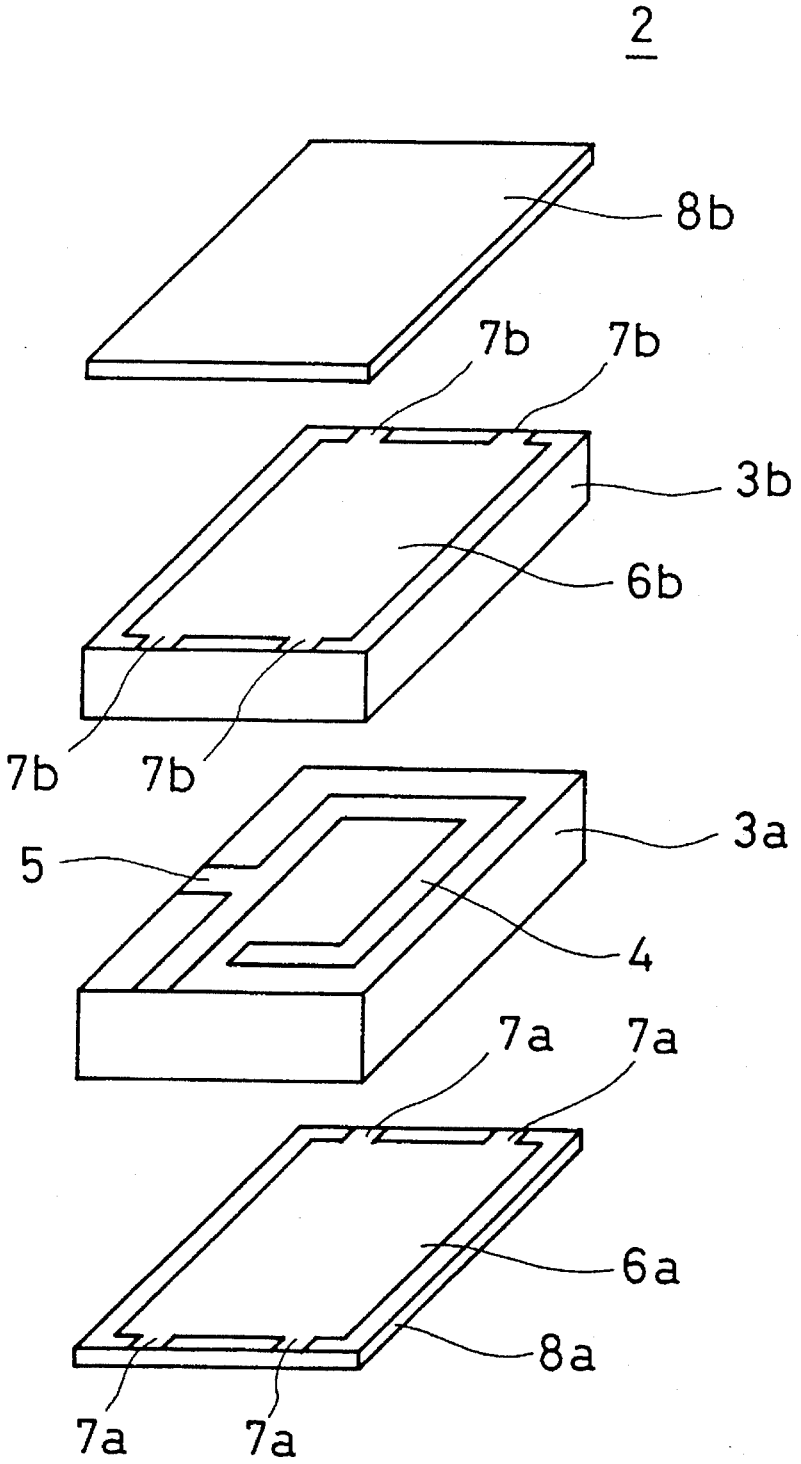
FIG. 35 PRIOR ART
FIG. 35 is an exploded perspective view showing a laminated body used for the resonator shown in FIG. 33.
Figure 36:
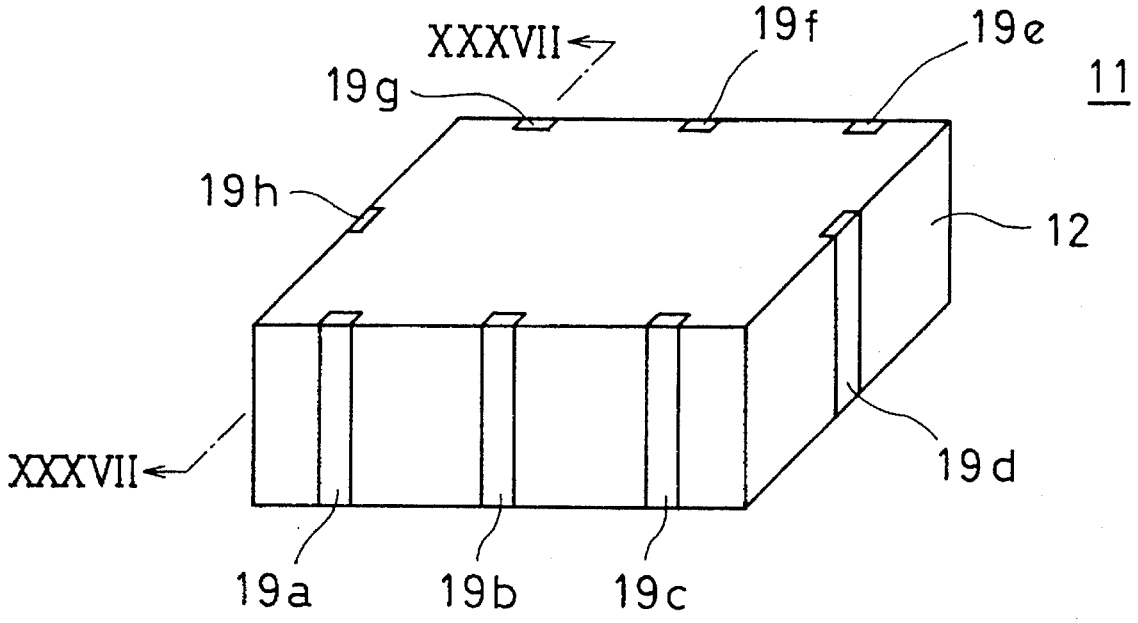
FIG. 36 PRIOR ART
FIG. 36 is a perspective view showing a conventional filter.
Figure 37:
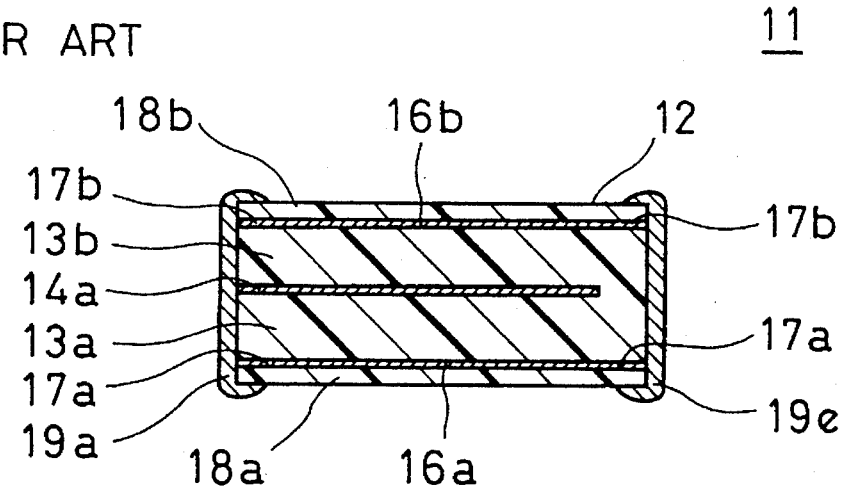
FIG. 37 PRIOR ART
FIG. 37 is a sectional view of line XXXVII—XXXVII in FIG. 36.
Figure 38:
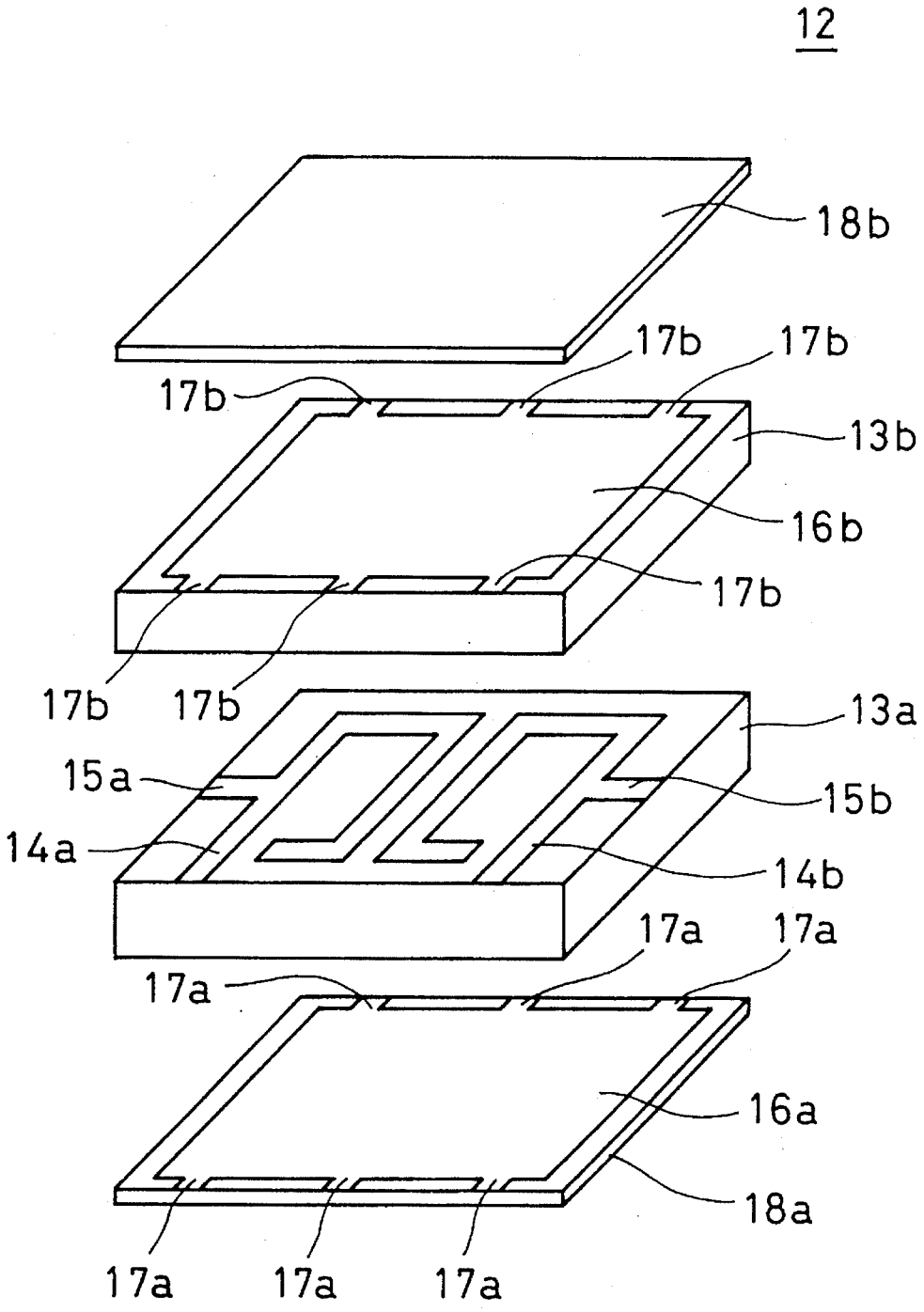
FIG. 38 PRIOR ART
FIG. 38 is an exploded perspective view showing a laminated body used for the filter shown in FIG. 36.

In the resonator 20, from the frequency characteristics shown in FIGS. 5–8, the Q value is high, having a value of 85 or more despite of the 1500 μm thickness between the first and the second earth electrodes, as compared with the resonator 1 shown in FIG. 33 with Q value of 60 and 1600 μm thickness between the first and the second earth electrodes.

Figure 9:
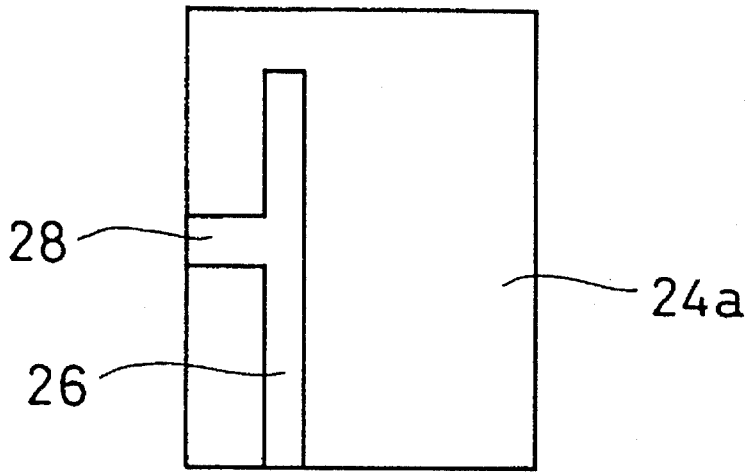
FIG. 9 is a plan view showing another embodiment of the line electrode used for the resonator shown in FIG. 1.
Figure 10:
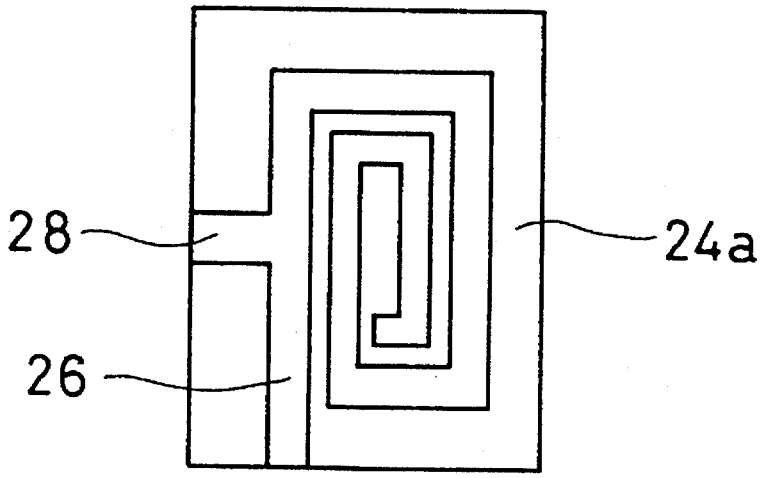
FIG. 10 is a plan view showing still another embodiment of the line electrode used for the resonator shown in FIG. 1.

In the embodiments shown in FIGS. 1–3, the line electrode 26 may be formed in an I-shape from the edge to the center portion on one surface of the first dielectric layer 24a as shown in FIG. 9. The line electrode 26 may be formed in a spiral shape from the edge to the center portion on one surface of the first dielectric layer 24a as shown in FIG. 10. Although not shown, the line electrode 26 may also be formed in a spiral shape from the edge to the center portion on one respective surfaces of more than one of the first dielectric layers by using a conductive through-hole passing through the respective laminated first dielectric layers. A similar effect as with the embodiments shown in FIGS. 1–3 is obtained when the shape of the line electrode is changed.

Figure 11:
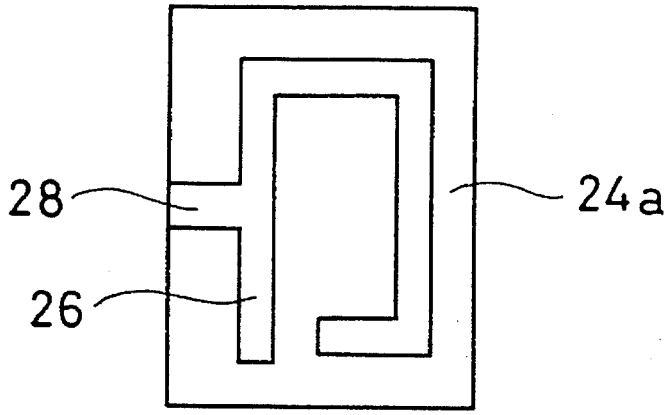
FIG. 11 is a plan view showing another embodiment of the line electrode used for the resonator shown in FIG. 1.
Figure 12:
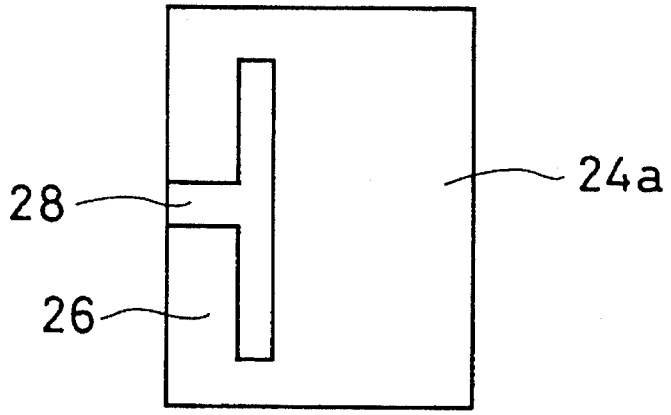
FIG. 12 is a plan view showing still another embodiment of the line electrode used for the resonator showing in FIG. 1.
Figure 13:
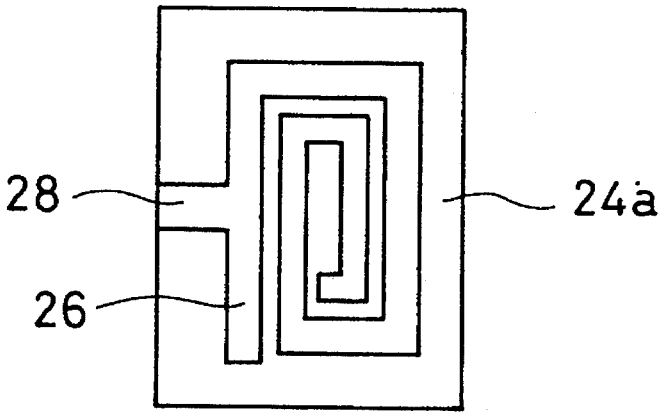
FIG. 13 is a plan view showing a still further embodiment of the line electrode used for the resonator showing in FIG. 1.

The line electrode 26 may be formed in a loop shape on the center portion of one surface of the first dielectric layer 24a as shown in FIG. 11, and may be formed in a I-shape on the center portion of one surface of the first dielectric layer 24a as shown in the FIG. 12, and may be formed in a spiral shape on the center portion of one surface of the first dielectric layer 24a as shown in FIG. 13. Although not shown, the line electrode may also be formed in a spiral shape from the edge to the center portion on respective surfaces of more than one of the first dielectric layers by using a conductive through-hole passing through the respective laminated first dielectric layers. In FIGS. 11–13, the external electrode 36a used as the earth terminal is not connected to the line electrode 26. In this case, a λ/2 resonator is formed.

In the case that λ/2 resonator is formed in above mentioned manner, the earth terminal that is the external electrode 36a is not connected to the line electrode 26 even when the external electrode 36a is formed on a side face of the first dielectric layer 24a, since the line electrode 26 is formed on the center portion of one surface of the first dielectric layer 24a.

In the case of the λ/2 resonator, the resonator has features of small size, high Q and low resonance frequency, that is similar to the embodiments shown in FIGS. 1–3.

Figure 14:
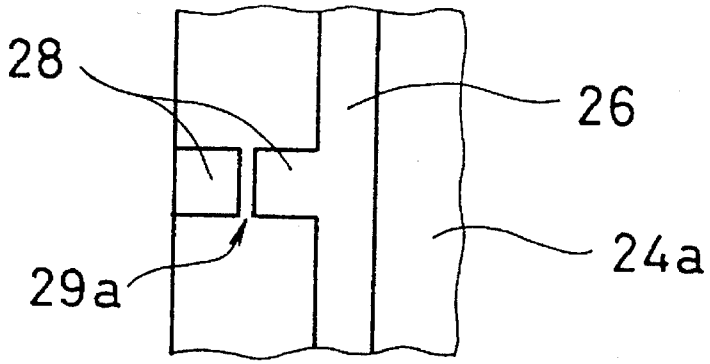
FIG. 14 is a plan view showing another embodiment of a method of the connection between line electrode and input/output terminal.
Figure 15:
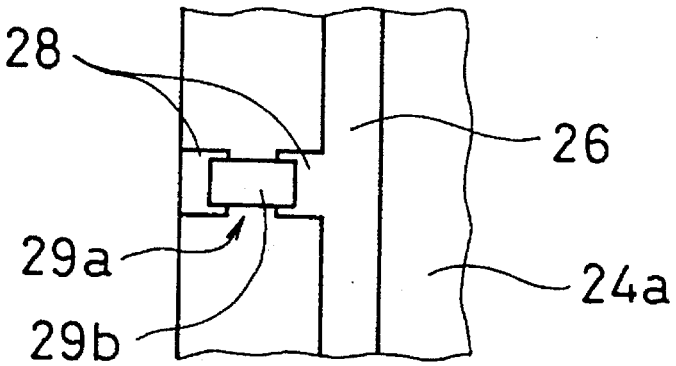
FIG. 15 is a plan view showing still another embodiment of a method of the connection between line electrode and input/output terminal.

In the embodiments shown in FIGS. 1–3, the external electrode 36f used as the input/output terminal is connected to the intermediate portion of the line electrode 26 via take-out electrode 28. It may be replaced by the configuration shown in FIG. 14 which inserts a capacitance formed by a gap 29a formed in take-out electrode 28, or that shown in FIG. 15 inserting a capacitor 29b formed on or connected to the gap 29a formed in take-out electrode 28. FIGS. 14–15 are also applicable to the embodiments shown in FIGS. 11–13.

Figure 16:
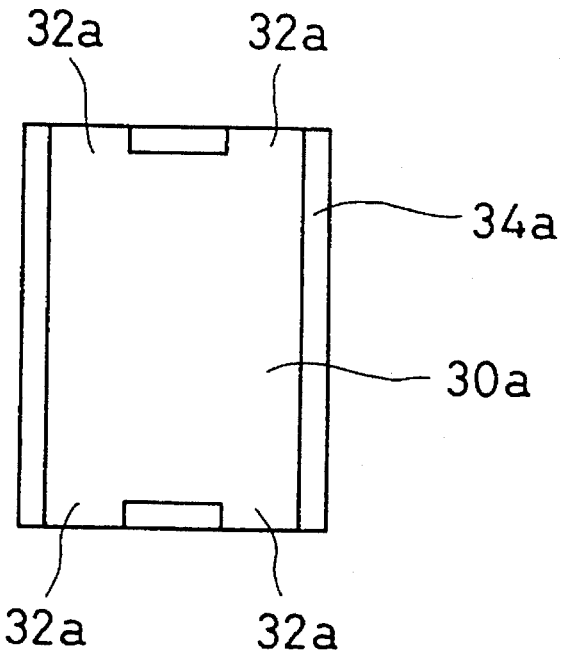
FIG. 16 is a plan view showing another embodiment of first earth electrode.
Figure 17:
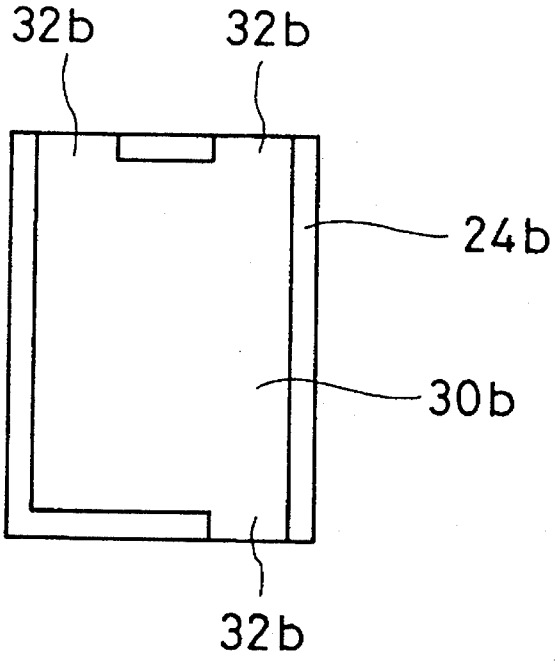
FIG. 17 is a plan view showing another embodiment of second earth electrode.

In the embodiments shown in FIGS. 1–3, though the lead-out electrodes 32a and 32b of the first and the second earth electrodes 30a and 30b are formed with narrow width, the lead-out electrodes 32a and 32b may be formed with wide width as shown in FIGS. 16 and 17. The shape of the lead-out electrodes 32a and 32b may be optionally changed. The position or number of the lead-out electrodes 32a and 32b may be optionally changed.

Figure 18:
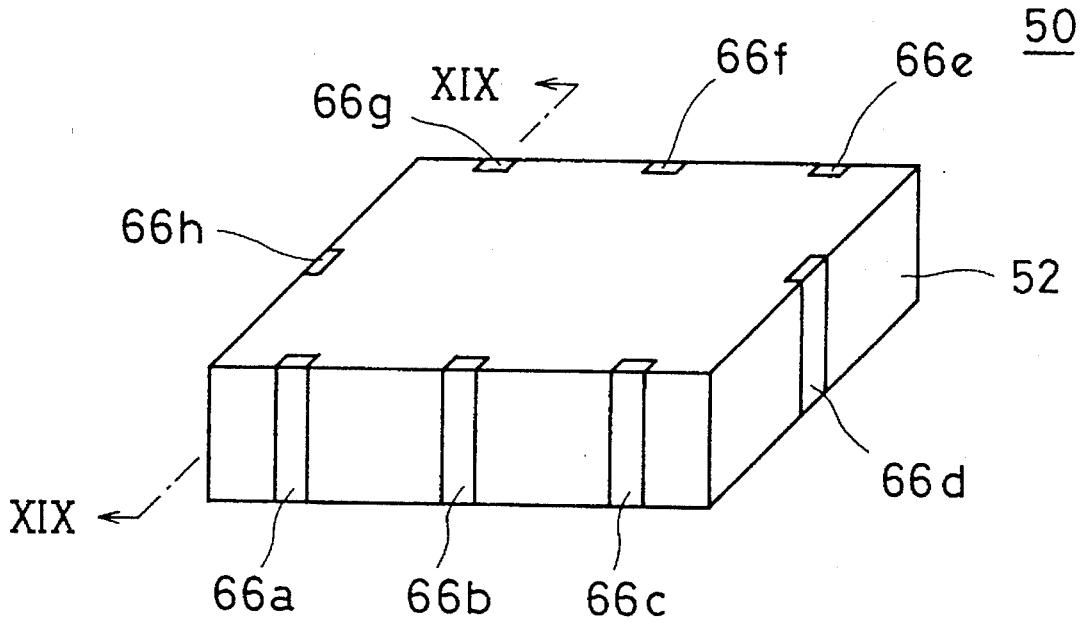
FIG. 18 is a perspective view showing a filter as an embodiment of the present invention.
Figure 19:
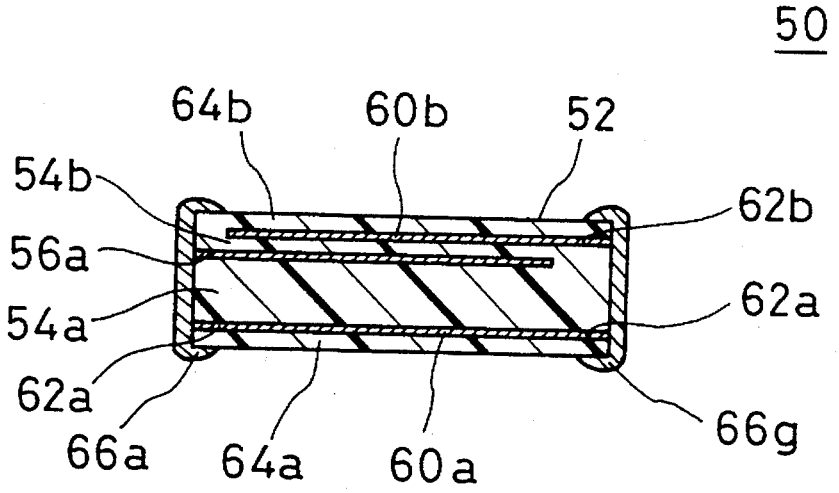
FIG. 19 is a sectional view of line XIX—XIX in FIG. 18.
Figure 20:
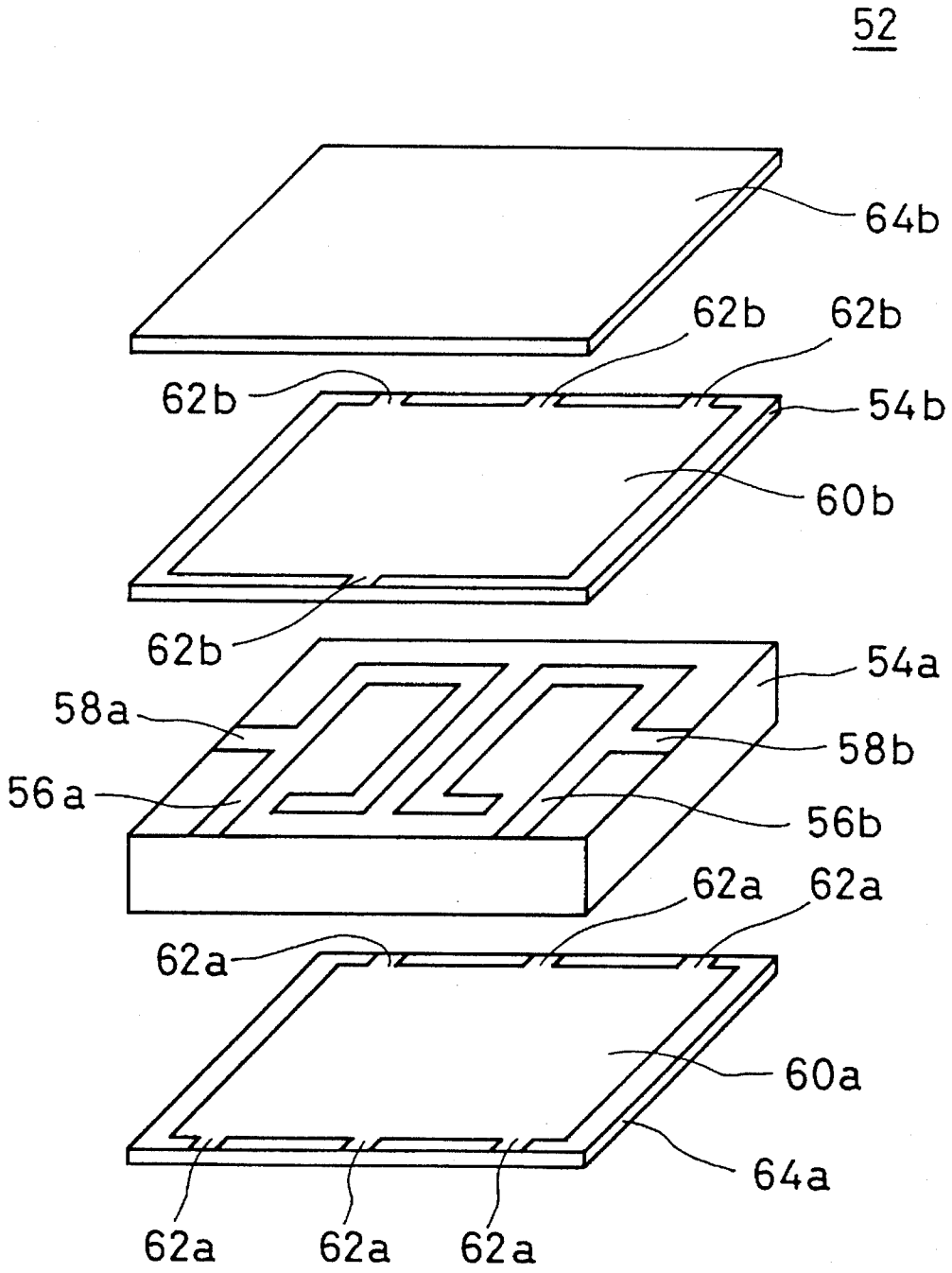
FIG. 20 is an exploded perspective view showing a laminated body used for the filter shown in FIG. 18.

FIG. 18 is a perspective view showing an embodiment of a filter of the present invention, and FIG. 19 is a sectional view of line XIX—XIX in FIG. 18, and FIG. 20 is an exploded perspective view showing a laminated body used for the filter shown in FIG. 18. A filter 50 includes a laminated body 52 having a rectangular prism shape. The laminated body 52 includes a first dielectric layer 54a having a rectangular shape.

On a first surface of the first dielectric layer 54a, first and second line electrodes 56a and 56b having, for example, loop shape are formed separately. The first and the second line electrodes 56a and 56b are formed symmetrically from one end to the center portion on the first surface of the first dielectric layer 54a. The first and the second line electrodes 56a and 56b are coupled electromagnetically. The first and the second line electrodes 56a and 56b act as inductors of the resonators.

On the first surface of the first dielectric layer 54a, first and second take-out electrodes 58a and 58b having, for example, strip shape are formed from the intermediate portions of the first and the second line electrodes 56a and 56b to two opposite edges of the first dielectric layer 54a.

Adjacent the other surface of the first dielectric layer 54a, a first earth electrode 60a is formed. The first earth electrode 60a has six lead-out electrodes 62a. The lead-out electrodes 62a are formed so as to extend to two sides of the other surface of the first dielectric layer 54a, including portions corresponding to the first ends of the first and the second line electrodes 56a and 56b.

Adjacent the other surface of the first earth electrode 60a, a first protection layer 64a is formed with, for example, dielectric material so as to cover the first earth electrode 60a.

On one surface of the first dielectric layer 54a, a second dielectric layer 54b is formed so as to cover the first and the second line electrodes 56a and 56b and the like.

On the second dielectric layer 54*b*, a second earth electrode 60*b* is formed. The second earth electrode 60*b* has four lead-out electrodes 62*b*. The lead-out electrodes 62*b* are not formed on the portions corresponding to the first ends of the first and the second line electrodes 56*a* and 56*b*, so as to extend to two sides of the second dielectric layer 54*b* at position corresponding to four of the lead-out electrodes 62*a* of the first earth electrode 60*a*.

On the second dielectric layer 54*b*, a second protection layer 64*b* is formed with, for example, dielectric material so as to cover the second earth electrode 60*b*.

On side faces of the laminated body 52, eight external electrodes 66*a*–66*h* are formed. The external electrode 66*a* is connected to the first end of the first line electrode 56*a* and the lead-out electrode 62*a* of the first earth electrode 60*a*. The external electrode 66*c* is connected to the first end of the second line electrode 56*b* and the lead-out electrode 62*a* of the first earth electrode 60*a*. The external electrodes 66*a* and 66*c* are used as earth terminals. The external electrodes 66*b*, 66*e*, 66*f* and 66*g* are connected to the lead-out electrodes 62*a* and 62*b* of the first and the second earth electrodes 60*a* and 60*b*. The external electrodes 66*b*, 66*e*, 66*f* and 66*g* are used as connecting electrodes having impedance. The external electrode 66*h* is connected to the first take-out electrode 58*a* of the first line electrode 56*a*. The external electrode 66*d* is connected to the second take-out electrode 58*b* of the second line electrode 56*b*. The external electrodes 66*h* and 66*d* are used as input/output terminals.

Figure 21:
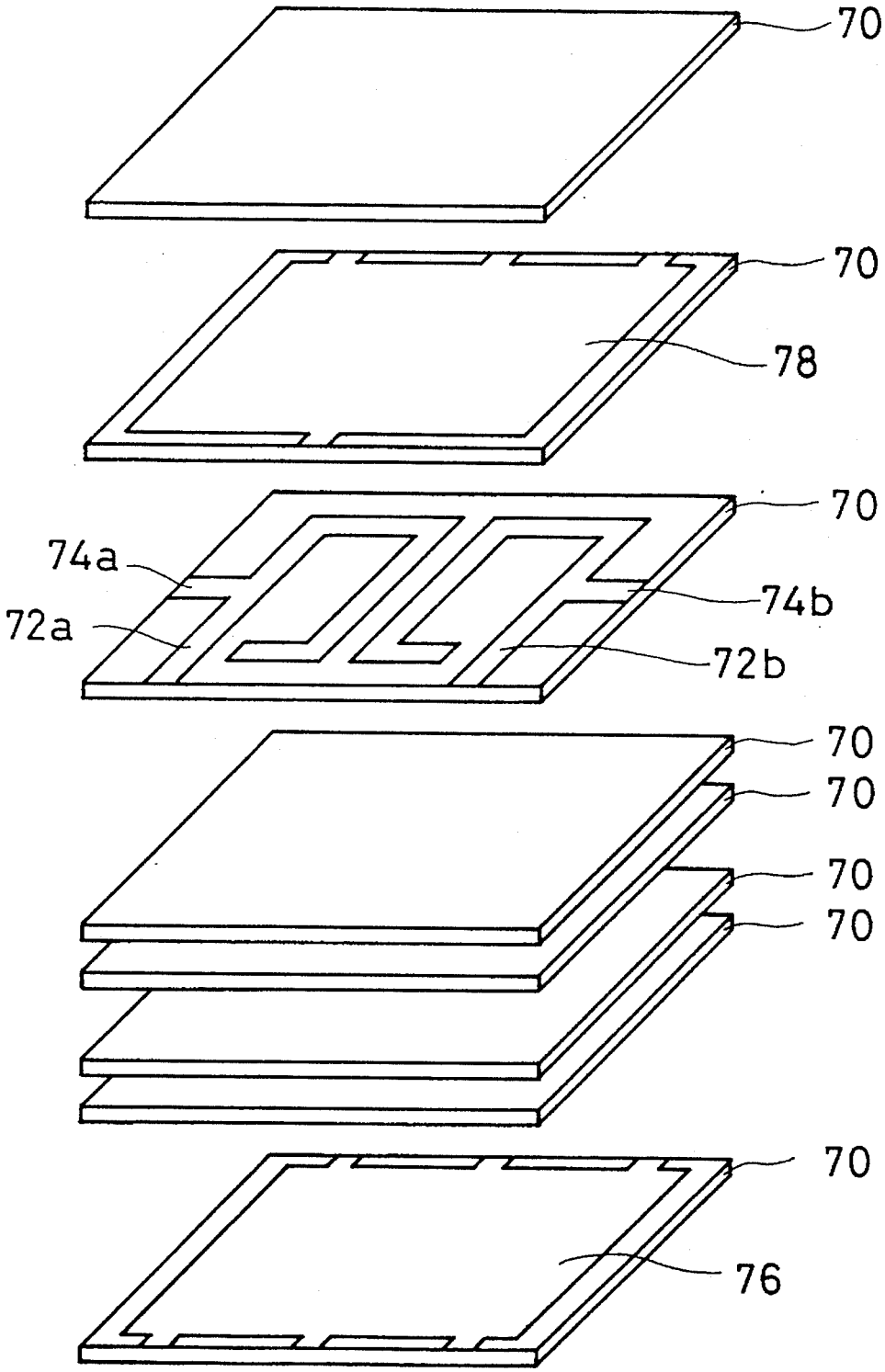
FIG. 21 is an exploded perspective view showing one process of manufacturing the filter shown in FIG. 18.

As shown in FIG. 21, plural rectangular ceramic green sheets 70 formed with dielectric material are prepared to form the filter 50.

On one sheet 70, loop shaped first and second line electrode patterns 72*a*, 72*b* and strip shaped first and second take-out electrode patterns 74*a*, 74*b* are formed with copper paste or the like.

On another sheet 70, a first earth electrode pattern 76 is formed with copper paste or the like.

On still another sheet 70, a second earth electrode pattern 78 is formed with copper paste or the like.

The other sheets 70 are inserted between the sheets having electrode patterns as required. On the sheet 70 having the second earth electrode pattern 78, another sheet 70 is placed. A body is completed by laminating the sheets 70 and pressing it.

The external electrode patterns are formed on side faces of the body with copper paste or the like. The filter 50 is obtained by firing the body. The external electrodes may be formed by sintering electrode material to the body after firing the body without external electrode patterns.

In the filter 50, since the external electrodes 66*a* and 66*c* used as the earth terminals are connected to the first ends of the first and the second line electrodes 56*a*, 56*b* and the lead-out electrodes 62*a* of the first earth electrode 60*a*, the resonators formed with the first and the second line electrodes and the like are respectively λ/4 resonators.

In the filter 50, the external electrodes 66*a* and 66*c* used as the earth terminals are connected to the lead-out electrodes 62*b* of the second earth electrode 60*b* via impedance of external electrodes 66*b*, 66*e*, 66*f* and 66*g*. The electric potential of the second earth electrode 60*b* with respect to the line electrodes is higher than that of the first earth electrode 60*a*, and thus, does not affect the Q value. As a result, the filter having small insertion loss is obtained even when the distance between the first and the second line electrodes 56*a*, 56*b* and the second earth electrode 60*b* is reduced, namely when the second dielectric layer 54*b* is made thinner.

In the filter 50, since the first and the second line electrodes 56*a* and 56*b* are formed from the edge to the center portion on one surface of the first dielectric layer 54*a*, the external electrodes 66*a* and 66*c* used as earth terminals are connected to the first ends of the first and the second line electrodes 56*a* and 56*b* by forming them on side faces of the first dielectric layer 54*a*.

In the filter 50, when the second dielectric layer 54*b* is made thinner, the device can be miniaturized, also, the stray capacitance between the first and the second line electrodes 56*a*, 56*b* and the second earth electrode 60*b* is increased, resulting in a lowered center frequency. However, by increasing the thickness of the first dielectric layer 54*a* by the same amount the thickness of the second dielectric layer 54*b* is decreased, a filter having a lower insertion loss is obtained without enlargement of the device size.

Figure 22:
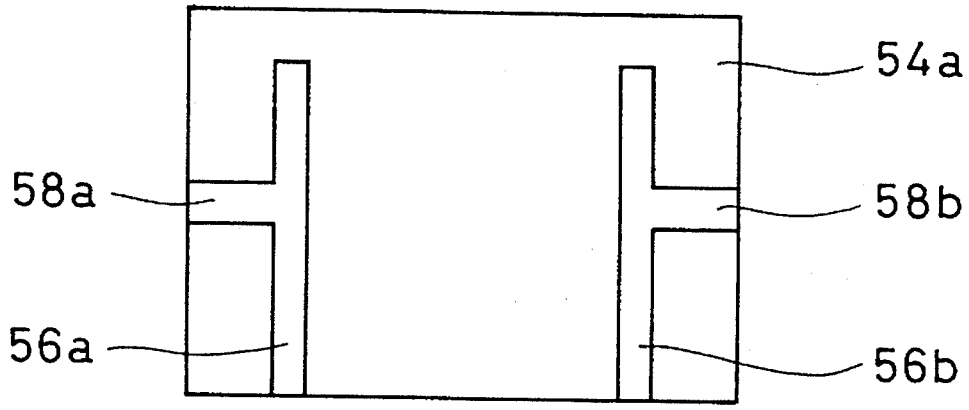
FIG. 22 is a plan view showing another embodiment of first and second line electrodes used for the filter shown in FIG. 18.
Figure 23:
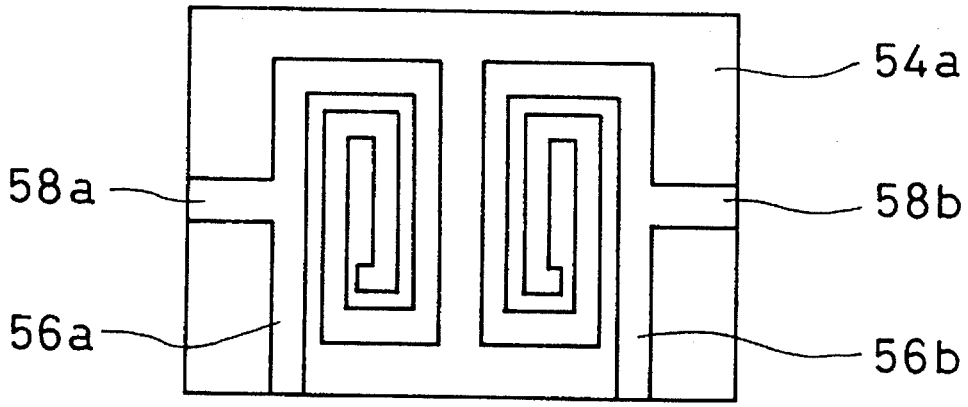
FIG. 23 is a plan view showing still another embodiment of first and second line electrodes used for the filter shown in FIG. 18.

In the embodiment shown in FIGS. 18–20, the first and the second line electrodes 56*a* and 56*b* may be formed in an I-shape from the edge to the center portion on one surface of the first dielectric layer 54*a* as shown in the FIG. 22. The first and the second line electrodes 56*a* and 56*b* may also be formed in a spiral shape from the edge to the center portion on one surface of the first dielectric layer 54*a* as shown in FIG. 23. The first and the second line electrodes 56*a* and 56*b* may further be formed in a spiral shape from the edge to the center portion on one respective surfaces of the plural first dielectric layers by connecting them with a through-hole made in the laminated first dielectric layers. As such, similar filter characteristics to those of the filter shown in FIGS. 18–20 are obtained when configuration of the first and the second line electrode shape is changed.

Figure 24:
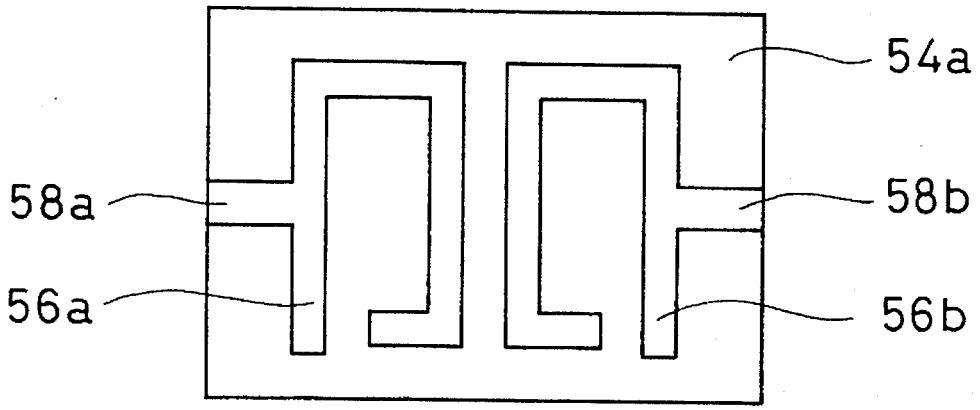
FIG. 24 is a plan view showing another embodiment of first and second line electrodes used for the filter shown in FIG. 18.
Figure 25:
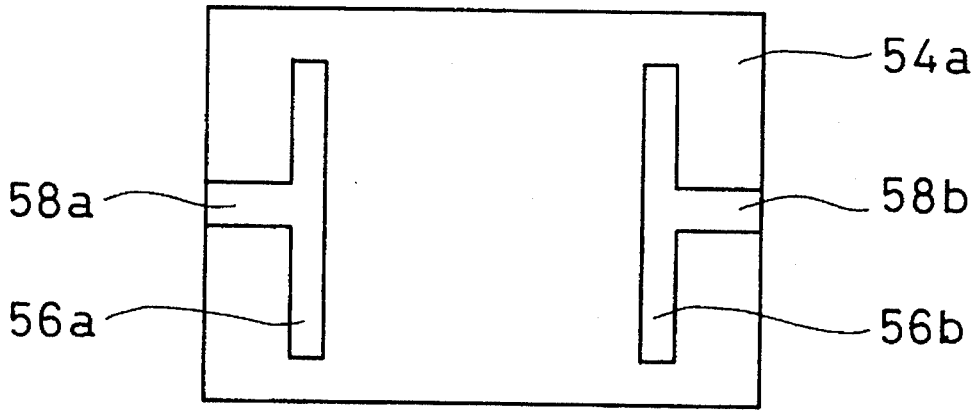
FIG. 25 is a plan view showing still another embodiment of first and second line electrodes used for the filter shown in FIG. 18.
Figure 26:
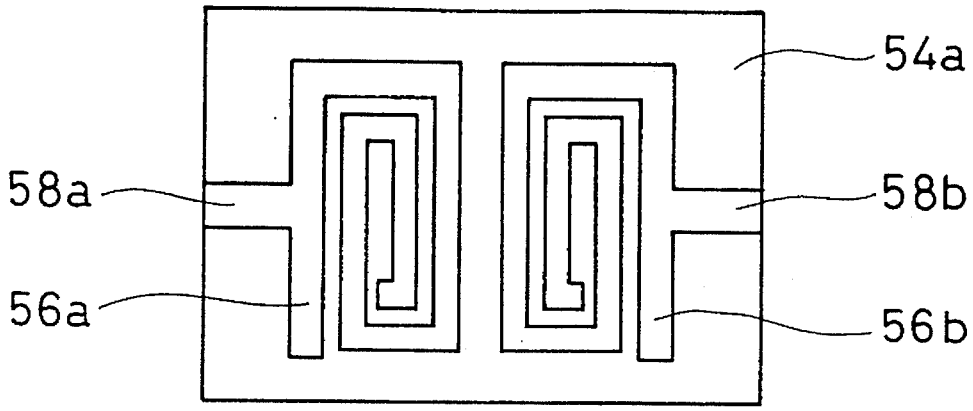
FIG. 26 is a plan view showing a still further embodiment of first and second line electrodes used for the filter shown in FIG. 18.

The first and the second line electrodes 56*a* and 56*b* may be formed in a loop shape on the center portion of one surface of the first dielectric layer 54*a* as shown in FIG. 24, and may be formed in an I-shape on the center portion of one surface of the first dielectric layer 54*a* as shown in FIG. 25, and may be formed in a spiral shape on the center portion of one surface of the first dielectric layer 54*a* as shown in FIG. 26, and may be formed in a spiral shape from the edge to the center portion on respective surfaces of the plural first dielectric layers by connecting them with a through-hole made in the laminated first dielectric layers. The external electrodes 66*a* and 66*c* used as the earth terminals are not connected to the first and the second line electrodes 56*a* and 56*b*. In this case, the filter consists of two λ/2 resonators.

In the case that λ/2 resonators are formed in the above mentioned manner, the external electrodes 66*a* and 66*b* are not connected to the first and the second line electrodes 56*a* and 56*b*, even though the external electrodes 66*a* and 66*c* are formed on the side face of the first dielectric layer 54*a*, since the first and the second line electrodes 56*a* and 56*b* are formed on the center portion of one surface of the first dielectric layer 54*a*.

In the case that λ/2 resonators are formed in the filter, the filter has features of small size, low insertion loss and lower center frequency, that is similar to the embodiments shown in FIGS. 18–20.

Figure 27:
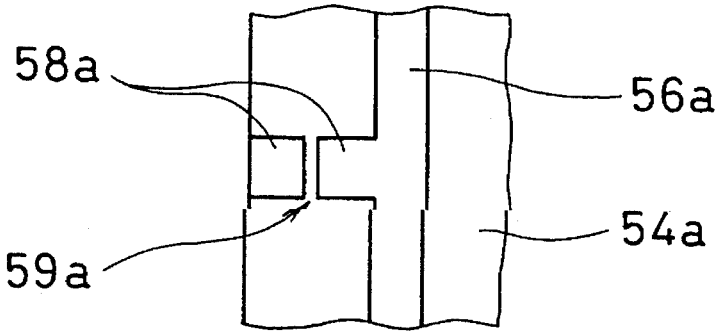
FIG. 27 is a plan view showing another embodiment of a method of connection between line electrodes and input/output terminals.
Figure 28:
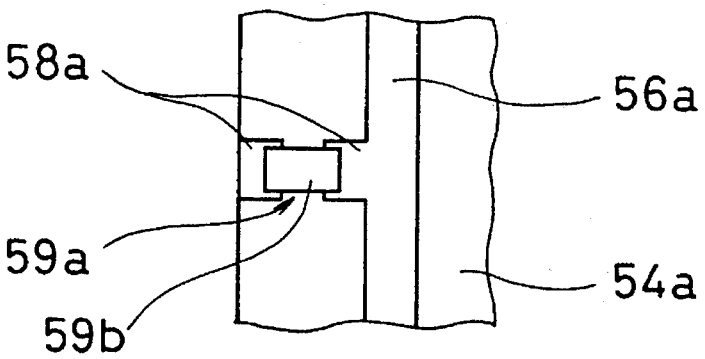
FIG. 28 is a plan view showing still another embodiment of a method of connection between line electrodes and input/output terminals.

In the embodiments shown in FIGS. 18–20, the external electrode 66*h* used as the input/output terminal is connected to the intermediate portion of the first line electrode 56*a* via the first take-out electrode 58. However, it may be replaced by the configuration shown in FIG. 27 which has a capacitance provided by a gap 59*a* formed in the first take-out electrode 58*a* or the configuration shown in FIG. 28 which has a capacitor 59b formed on or connected to the gap 59a formed in the first take-out electrode 58a. The external electrode 66d used as the input/output terminal may be connected to the intermediate portion of the second line electrode 56b, and a similar connection may be made between the external electrode 66h and the intermediate portion of the first line electrode 56a. It is also applicable to the embodiments shown in FIGS. 24–26.

Figure 29:
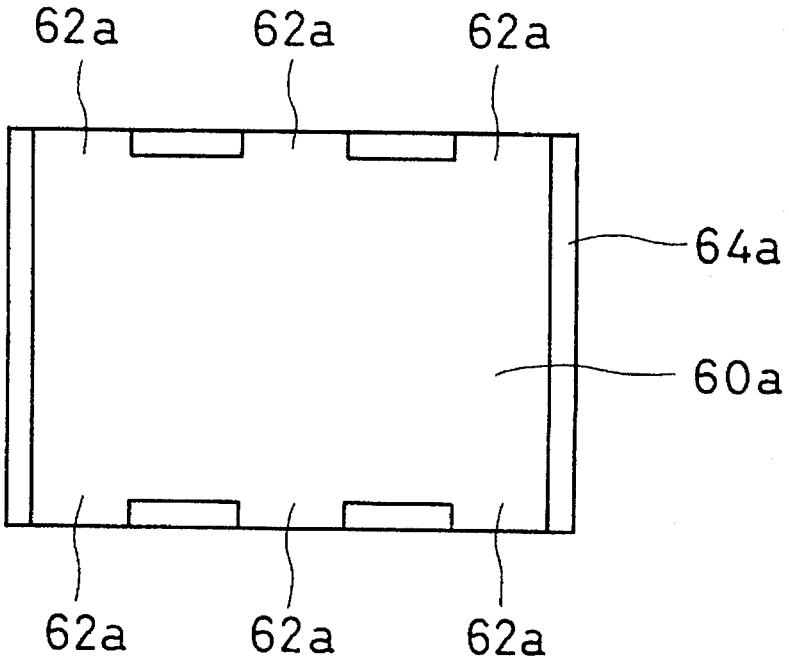
FIG. 29 is a plan view showing another embodiment of first earth electrode.
Figure 30:
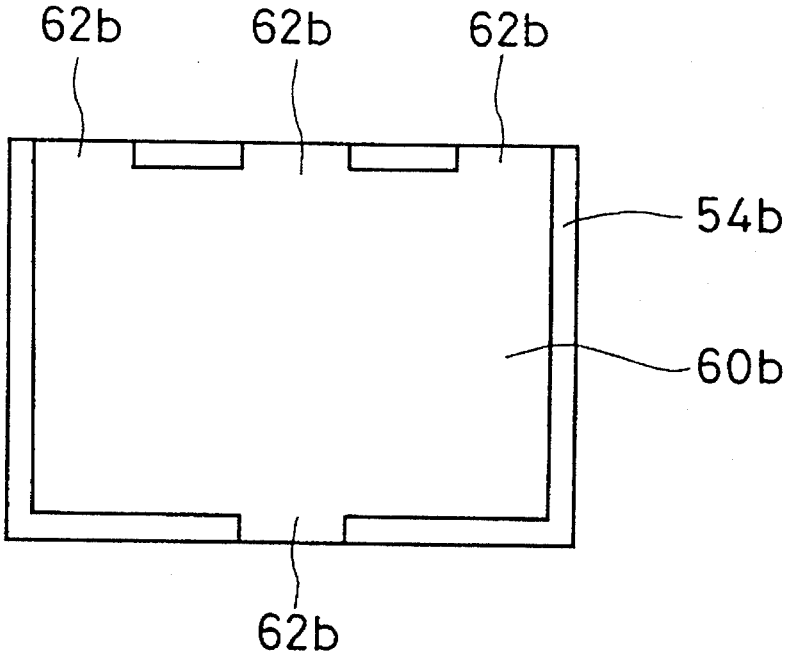
FIG. 30 is a plan view showing another embodiment of second earth electrode.

In the embodiments shown in FIG. 18–20, though the lead-out electrodes 62a and 62b of the first and the second earth electrodes 60a and 60b are formed with narrow width, the lead-out electrodes 62a and 62b may be formed with wide width as shown in FIGS. 29 and 30. The shape of the lead-out electrodes 62a and 62b may be optionally changed. And, the position or number of the lead-out electrodes 62a and 62b may be optionally changed.

Figure 31:
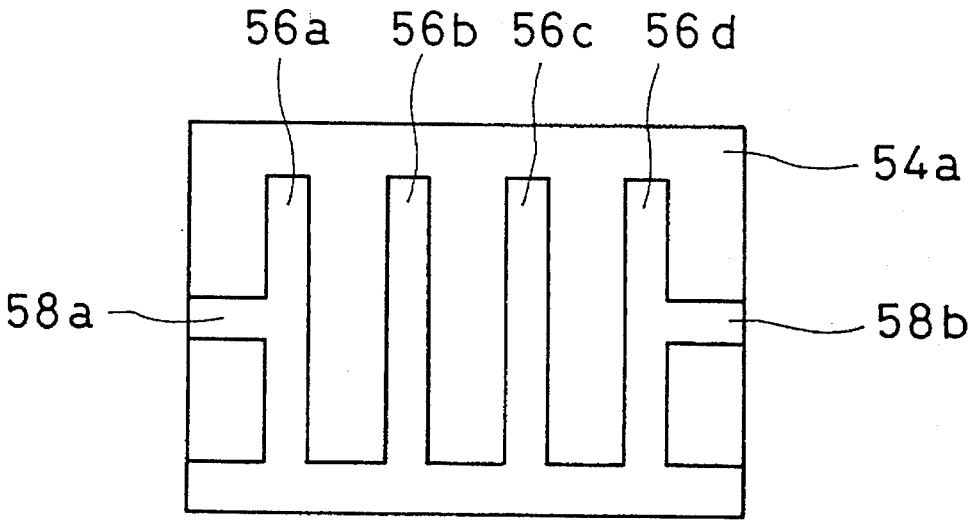
FIG. 31 is a plan view showing a main part of a filter as another embodiment of the present invention.
Figure 32:
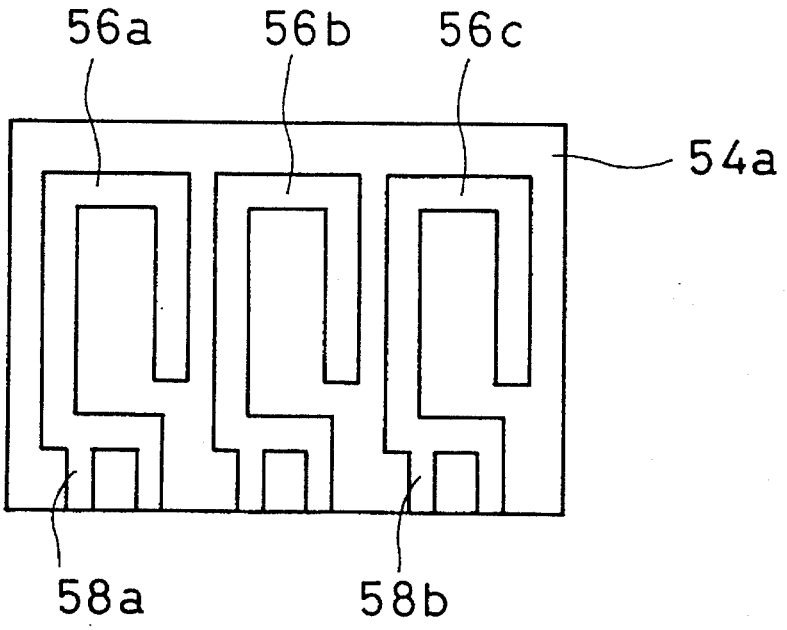
FIG. 32 is a plan view showing a main part of a filter as still another embodiment of the present invention.

In the above embodiment, though the filter with two resonators is explained, a filter with four resonators may be produced by forming four I-shaped line electrodes 56a, 56b, 56c and 56d on one surface of the first dielectric layer 54a as shown in FIG. 31, or a filter with three resonators may be produced by forming three loop-shaped line electrodes 56a, 56b and 56c on one surface of the first dielectric layer 54a as shown in FIG. 32.

In all of above embodiments, though devices having first and the second dielectric layers with the same material are described, different materials may be used for the first and the second dielectric layers. And, the whole area or a partial area of each of the first and the second dielectric layers may have different dielectric constants. In case of the material or the dielectric constant is changed, the thickness of the whole area or a partial area may be adjusted according to the dielectric constant. For example, when a material having high dielectric constant is used for the second dielectric layer, the resonant frequency or center frequency can be lowered without reducing the thickness of the layer.

The combination of the above mentioned embodiments is also within the range of the concept of the invention.

While embodiments of the present invention have been particularly described and shown, it is to be understood that such description is used merely as an illustration and example rather as a limitation, and the spirit and scope of the present invention is determined solely by the terms of the appended claims.

What is claimed is:

1. A resonator comprising:

a first protection layer, a first ground electrode formed on said first protection layer, a first dielectric layer formed on said first ground electrode, a quarter wavelength line electrode formed on said first dielectric layer, an input/output terminal connected to an intermediate portion of said line electrode, a second dielectric layer formed on said line electrode and said input/output terminal, a second ground electrode formed on said second dielectric layer, a second protection layer formed on said second ground electrode, a ground terminal connected at a connecting point to a first end of said line electrode and said first ground electrode, and not connected directly to said second ground electrode, and a connecting electrode having impedance that is connected to said first ground electrode and said second ground electrode at a location spaced away from said connecting point of said line electrode and said first ground electrode.

2. A resonator in accordance with claim 1, wherein said line electrode is formed from the edge to the center portion on one surface of said first dielectric layer.

3. A resonator in accordance with claim 2, wherein said second dielectric layer is formed thinner than said first dielectric layer.

4. A resonator in accordance with claim 1, wherein said second dielectric layer is formed thinner than said first dielectric layer.

5. A resonator comprising:

a first protection layer, a first ground electrode formed on said first protection layer, a first dielectric layer formed on said first ground electrode, a half wavelength line electrode formed on said first dielectric layer, an input/output terminal connected to an intermediate portion of said line electrode, a second dielectric layer formed on said line electrode and said input/output terminal, a second ground electrode formed on said second dielectric layer, a second protection layer formed on said second ground electrode, a ground terminal connected at a connecting point to said first ground electrode, and not connected directly to said second ground electrode, and a connecting electrode having impedance that is connected to said first ground electrode and said second ground electrode at a location spaced away from said connecting point of said ground terminal and said first ground electrode.

6. A resonator in accordance with claim 5, wherein said line electrode is formed at center portion on one surface of said first dielectric layer.

7. A resonator in accordance with claim 6, wherein said second dielectric layer is formed thinner than said first dielectric layer.

8. A resonator in accordance with claim 1, wherein said second dielectric layer is formed thinner than said first dielectric layer.

9. A filter comprising:

a first protection layer, a first ground electrode formed on said first protection layer, a first dielectric layer formed on said first ground electrode, plural quarter wavelength line electrodes formed separately on said first dielectric layer and coupled electromagnetically with each other, two input/output terminals connected respectively to intermediate portions of two of said plural line electrodes, a second dielectric layer formed on said plural line electrodes and said input/output terminals, a second ground electrode formed on said second dielectric layer, a second protection layer formed on said second ground electrode, ground terminals connected at respective connecting points to respective first ends of said plural line electrodes and to said first ground electrode, and not connected directly to said second ground electrode, and a connecting electrode having impedance that is connected to said first ground electrode and said second ground electrode at a location spaced away from said connecting points of said plural line electrodes and said first ground electrode.

10. A filter in accordance with claim 9, wherein said plural line electrodes are formed from the edge to the center portion on one surface of said first dielectric layer.

11. A filter in accordance with claim 10, wherein said second dielectric layer is formed thinner than said first dielectric layer.

12. A filter in accordance with claim 9, wherein said second dielectric layer is formed thinner than said first dielectric layer.

13. A filter comprising:

a first protection layer, a first ground electrode formed on said first protection layer, a first dielectric layer formed on said first ground electrode, plural half wavelength line electrodes formed separately on said first dielectric layer and coupled electromagnetically with each other, two input/output terminals connected respectively to intermediate portions of two of said plural line electrodes, a second dielectric layer formed on said plural line electrodes and said input/output terminals, a second ground electrode formed on said second dielectric layer, a second protection layer formed on said second ground electrode, ground terminals connected at respective connecting points to said first ground electrode, and not connected directly to said second ground electrode, and a connecting electrode having impedance that is connected to said first ground electrode and said second ground electrode at a location spaced away from said connecting points of said ground terminals and said first ground electrode.

14. A filter in accordance with claim 13, wherein said plural line electrodes are formed at center portion on one surface of said first dielectric layer.

15. A filter in accordance with claim 14, wherein said second dielectric layer is formed thinner than said first dielectric layer.

16. A filter in accordance with claim 13, wherein said second dielectric layer is formed thinner than said first dielectric layer.

* * * * *